US010947998B2

(12) United States Patent
Kojima

(10) Patent No.: US 10,947,998 B2
(45) Date of Patent: Mar. 16, 2021

(54) FLUID PRESSURE CYLINDER

(71) Applicant: SMC CORPORATION, Chiyoda-ku (JP)

(72) Inventor: Yusuke Kojima, Moriya (JP)

(73) Assignee: SMC CORPORATION, Chiyoda-ku (JP)

( * ) Notice: Subject to any disclaimer, the term of this patent is extended or adjusted under 35 U.S.C. 154(b) by 176 days.

(21) Appl. No.: 15/565,242

(22) PCT Filed: Apr. 11, 2016

(86) PCT No.: PCT/JP2016/001975

§ 371 (c)(1),
(2) Date: Oct. 9, 2017

(87) PCT Pub. No.: WO2016/166964

PCT Pub. Date: Oct. 20, 2016

(65) Prior Publication Data

US 2018/0080483 A1 Mar. 22, 2018

(30) Foreign Application Priority Data

Apr. 17, 2015 (JP) ..... JP2015-084721
Jul. 10, 2015 (JP) ..... JP2015-138673
Mar. 16, 2016 (JP) ..... JP2016-052553

(51) Int. Cl.
*F15B 15/14* (2006.01)
*F15B 15/22* (2006.01)

(52) U.S. Cl.
CPC ..... *F15B 15/1438* (2013.01); *F15B 15/149* (2013.01); *F15B 15/1433* (2013.01); *F15B 15/226* (2013.01)

(58) Field of Classification Search
CPC ..... F16J 10/02
See application file for complete search history.

(56) References Cited

U.S. PATENT DOCUMENTS 2,518,787 A * 8/1950 Huhtala ..... F16J 10/02 92/144
2,673,130 A * 3/1954 Becker ..... 220/315
(Continued)

FOREIGN PATENT DOCUMENTS

DE 91 04 747 8/1992
DE 198 43 253 A1 3/2000
(Continued)

OTHER PUBLICATIONS

Office Action dated May 2, 2019 in German Patent Application No. 112016001787.1, citing document AO therein, 9 pages (with English translation).

(Continued)

*Primary Examiner* — Nathaniel E Wiehe
*Assistant Examiner* — Michael Quandt
(74) *Attorney, Agent, or Firm* — Oblon, McClelland, Maier & Neustadt, L.L.P.

(57) ABSTRACT

In a fluid pressure cylinder, cylindrical bodies are connected to both ends of a cylinder tube, and latching rings are disposed detachably in interior of the cylindrical bodies. A head cover and a rod cover, which are accommodated in the cylinder tube, are fixed by the latching rings. Recesses, which are recessed diametrally inward, are provided on outer circumferential surfaces of the head cover and the rod cover, respectively. First and second fluid ports open respectively in the recesses, and a pressure fluid is supplied and discharged through the first and second fluid ports.

9 Claims, 20 Drawing Sheets

(56) References Cited

U.S. PATENT DOCUMENTS

| | | | | | |
|---|---|---|---|---|---|
| 2,761,425 | A | * | 9/1956 | Bertsch | B62D 5/062 138/114 |
| 3,421,786 | A | | 1/1969 | Panigati | |
| 4,263,841 | A | | 4/1981 | Bimba | |
| 4,312,264 | A | * | 1/1982 | Nunnemacher | F16J 10/02 92/161 |
| 5,680,808 | A | * | 10/1997 | Day | F15B 15/1447 92/168 |
| 2015/0377262 | A1 | | 12/2015 | Besliu et al. | |

FOREIGN PATENT DOCUMENTS

| | | | |
|---|---|---|---|
| DE | 10 2007 048 907 | A1 | 4/2009 |
| EP | 0 964 164 | A1 | 12/1999 |
| JP | 9-133109 | A | 5/1997 |
| JP | 10-318213 | A | 12/1998 |
| JP | 11-311210 | A | 11/1999 |
| JP | 2000-337312 | A | 12/2000 |
| JP | 2014-129853 | A | 7/2014 |
| WO | 2014/124519 | A1 | 8/2014 |

OTHER PUBLICATIONS

Office Action dated May 21, 2019 in Korean Patent Application No. 10-2017-7033353, citing document AP therein, 9 pages (with English translation).

International Search Report dated Jul. 27, 2016 in PCT/JP2016/001975 filed Apr. 11, 2016.

* cited by examiner

FLUID PRESSURE CYLINDER

TECHNICAL FIELD

The present invention relates to a fluid pressure cylinder in which a piston is displaced along an axial direction under the supply of a pressure fluid.

BACKGROUND ART

Heretofore, as a means for transporting workpieces, for example, a fluid pressure cylinder has been used having a piston that is displaced under the supply of a pressure fluid. For example, as disclosed in Japanese Laid-Open Patent Publication No. 2014-129853 (Patent Document 1), in the fluid pressure cylinder, a head cover and a rod cover are disposed on both ends of the cylinder tube, a piston is disposed displaceably in the interior of the cylinder tube, and a piston rod connected to the piston is supported displaceably through the rod cover. Further, on outer circumferential surfaces of the head cover and the rod cover, ports are formed respectively for supplying and discharging the pressure fluid, and the ports project diametrally outward with respect to the outer circumferential surface of the cylinder tube.

Further, with the fluid pressure cylinder according to Japanese Laid-Open Patent Publication No. 2000-337312 (Patent Document 2), a head cover and a rod cover are connected respectively by screw-engagement with respect to both ends of a cylinder tube.

SUMMARY OF INVENTION

Although recently it has been desired to reduce the size of such fluid pressure cylinders, with the fluid pressure cylinder according to the aforementioned Patent Document 1, since the respective ports project diametrally outward with respect to the cylinder tube, the diametral dimension of the fluid pressure cylinder is increased in size.

Further, with the fluid pressure cylinder according to Patent Document 2, since it is necessary for female threaded portions to be disposed on both ends of the cylinder tube, and for male threaded portions to be provided for a predetermined length respectively on the outer circumferential surfaces of the head cover and the rod cover, the lengthwise dimension of the fluid pressure cylinder is made greater in size by the lengths of the female threaded portions and the male threaded portions.

A general object of the present invention is to provide a fluid pressure cylinder in which cover members can easily be attached/detached, while the size of the fluid pressure cylinder in the axial direction and the diametral direction can be kept small in size.

The present invention is characterized by a fluid pressure cylinder comprising a cylindrical cylinder tube including a cylinder chamber in interior thereof that is circular in cross section, cover members formed with circular shapes in cross section corresponding to the cylinder chamber and which are mounted in ends of the cylinder tube, and a piston disposed displaceably along the cylinder chamber, wherein:

a pair of ports through which a pressure fluid is supplied and discharged are provided on a more diametrally inward side than an outer circumferential surface of the cylinder tube; and latching members configured to latch the cover members in an axial direction are disposed in the ends of the cylinder tube, the latching members being engaged with respect to the cylinder tube and constituted from rings with resilient forces in a diametral direction, and the cover members are attachable and detachable with respect to the cylinder tube by attachment and detachment of the rings with respect to the cylinder tube.

According to the present invention, in the fluid pressure cylinder, the pair of ports through which the pressure fluid is supplied and discharged are provided on a more diametrally inward side than the outer circumferential side of the cylinder tube, and the latching members that latch the cover members in the axial direction are disposed in the ends of the cylinder tube, the latching members being engaged with respect to the cylinder tube and constituted from rings with a resilient force in the diametral direction, wherein the cover members are attachable and detachable with respect to the cylinder tube by attachment and detachment of the ring with respect to the cylinder tube.

Consequently, since the amount at which fittings or the like project outward in the diametral direction when such fittings are connected to the ports that are arranged on a diametrally inward side of the cylinder tube can be suppressed compared to a conventional fluid pressure cylinder, the fluid pressure cylinder can be reduced in size in the diametral direction. Further, by constituting the cover members to be fixed on ends of the cylinder tube by the latching members, in comparison with a conventional fluid pressure cylinder in which the cover members are fixed by screw-engagement with respect to the cylinder tube, since there is no need for screw members or the like for effecting such screw-engagement, the fluid pressure cylinder can be reduced in size in the axial direction due to the absence of such screw members. Furthermore, since the cover members are fixed with respect to the cylinder tube by the latching members, and the fixed state thereof can be released easily by removing the rings that serve as the latching members, in comparison with a conventional fluid pressure cylinder in which the cover members are screw-engaged with respect to the cylinder tube, the attachment and detachment operations of the cover members with respect to the cylinder tube can more easily be performed.

The above and other objects, features, and advantages of the present invention will become more apparent from the following description when taken in conjunction with the accompanying drawings, in which preferred embodiments of the present invention are shown by way of illustrative example.

DESCRIPTION OF EMBODIMENTS

Figure 1:
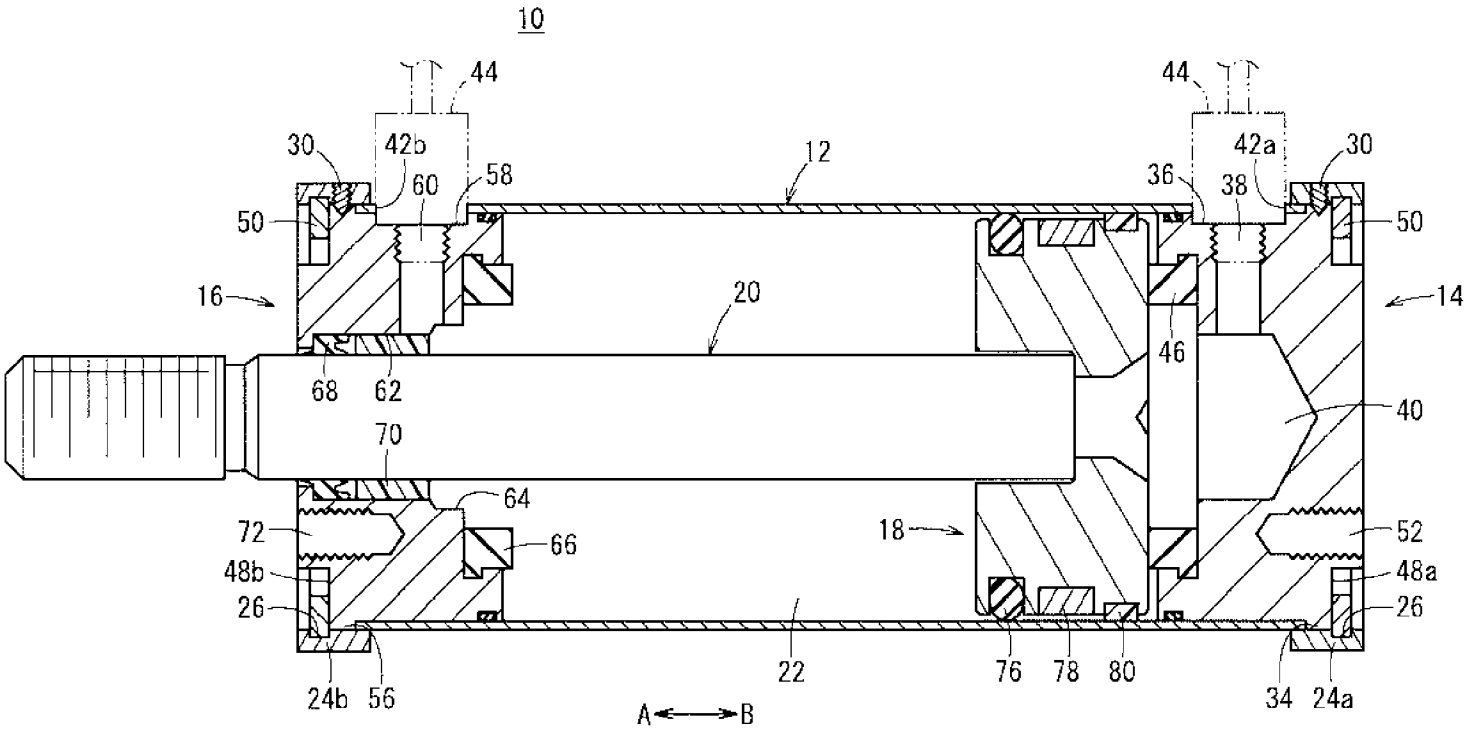
FIG. 1 is an overall cross-sectional view of a fluid pressure cylinder according to a first embodiment of the present invention.

As shown in FIG. 1, a fluid pressure cylinder 10 includes a cylindrical cylinder tube 12, a head cover (cover member) 14 mounted in one end of the cylinder tube 12, a rod cover (cover member) 16 mounted in another end of the cylinder tube 12, a piston 18 that is disposed displaceably in the interior of the cylinder tube 12, and a piston rod 20 that is connected to the piston 18.

The cylinder tube 12, for example, is formed from a metal material such as stainless steel or the like, and is made up from a tubular body that extends with a constant cross-sectional area in the axial direction (the directions of arrows A and B), and in the interior thereof, a cylinder chamber 22 is formed in which the piston 18 and the piston rod 20 are accommodated. Further, cylindrical bodies 24*a*, 24*b*, which are larger in diameter than the cylinder tube 12, are connected respectively to both ends of the cylinder tube 12.

Figure 2A:
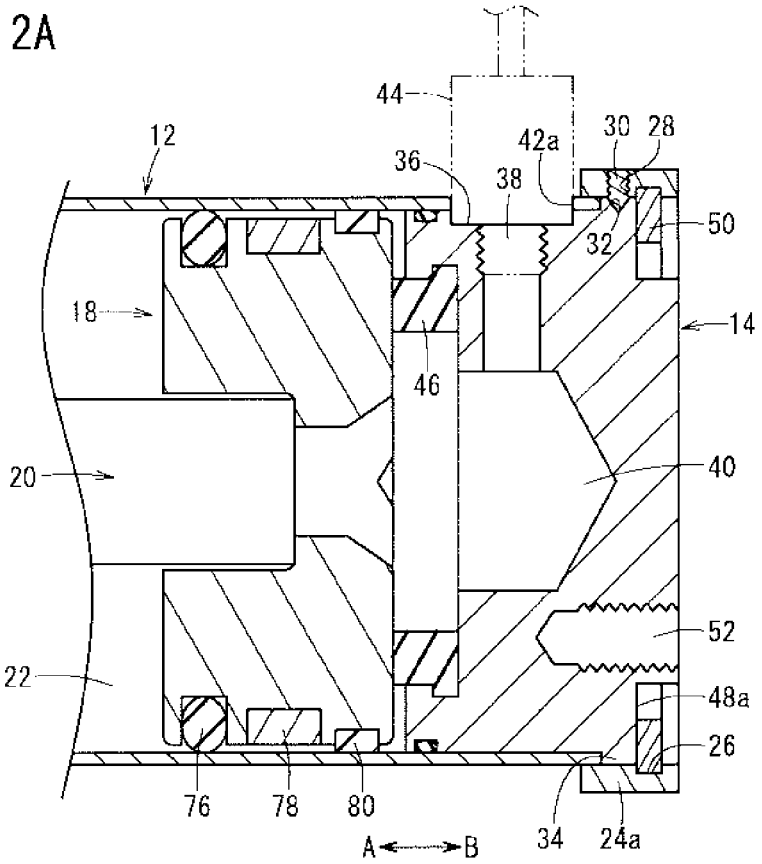
FIG. 2A is an enlarged cross-sectional view showing the vicinity of a head cover in the fluid pressure cylinder of FIG. 1.
Figure 3A:
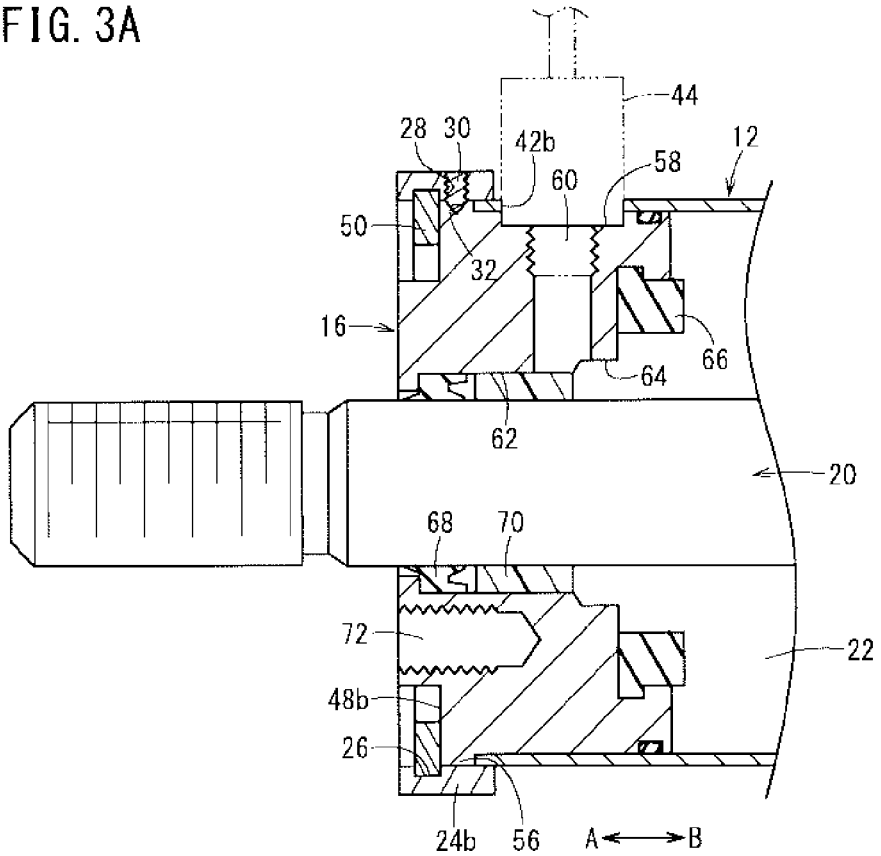
FIG. 3A is an enlarged cross-sectional view showing the vicinity of a rod cover in the fluid pressure cylinder of FIG. 1.

As shown in FIGS. 1, 2A, and 3A, the cylindrical bodies 24*a*, 24*b*, for example, are formed from a metal material such as stainless steel or the like with circular shapes in cross section, and have a predetermined width along the axial direction. In addition, in the cylindrical bodies 24*a*, 24*b*, inner circumferential surfaces of ends thereof are joined respectively by welding in a state of abutment against the outer circumferential surface of the cylinder tube 12. More specifically, portions of the cylindrical bodies 24*a*, 24*b* are disposed in an overlapping manner in the axial direction (the directions of arrows A and B) with respect to both ends of the cylinder tube 12, and the opposite ends of the cylinder tube 12 are formed in stepwise shapes by the cylindrical bodies 24*a*, 24*b*, which are expanded in diameter, being disposed on the outer side in the diametral directions with respect to the cylinder tube 12.

Further, annular engagement grooves 26, which are recessed diametrally outward, are formed on the inner circumferential surface of the cylindrical bodies 24*a*, 24*b*, and later-described latching rings 50 are engaged respectively therein.

Furthermore, holes 28, which penetrate diametrally between the engagement grooves 26 and the connection sites to which the cylinder tube 12 is connected, are formed in the cylindrical bodies 24*a*, 24*b*. Rotation preventing screws (pin members) 30 are screw-engaged from an outer circumferential side in the holes 28, and are engaged respectively in screw holes 32 formed in outer circumferential surfaces of the head cover 14 and the rod cover 16. Owing thereto, rotational displacement of the cylindrical bodies 24*a*, 24*b*, respectively, with respect to the head cover 14 and the rod cover 16 is restricted.

Stated otherwise, the rotation preventing screws 30 function as rotation preventing means for restricting rotational displacement of the cylindrical bodies 24*a*, 24*b* with respect to the head cover 14 and the rod cover 16.

Figure 2B:
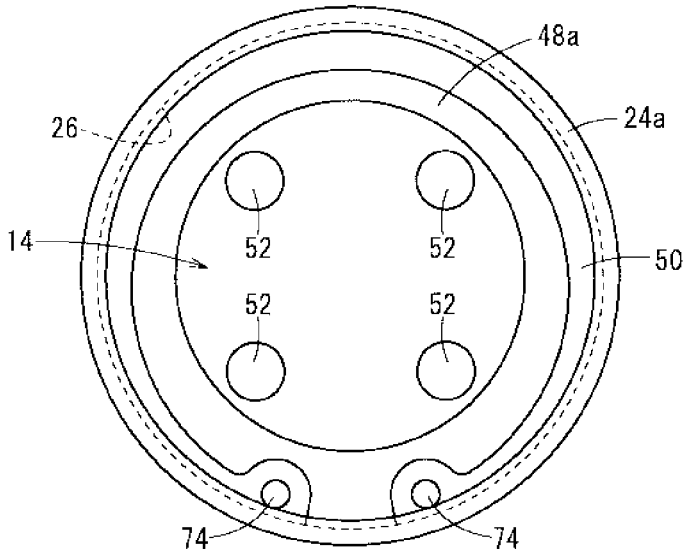
FIG. 2B is a front view in which the head cover is observed from an axial direction.

As shown in FIGS. 1 through 2B, the head cover 14, for example, is formed with a circular shape in cross section from a metal material such as stainless steel or the like, and is inserted into the interior of the cylinder tube 12 and the cylindrical body 24*a*.

The outer circumferential surface of the head cover 14 is formed in a stepwise shape, such that the other end side thereof (in the direction of the arrow B) expands slightly in diameter, and by abutment of the one end of the cylinder tube 12 against the stepped portion 34, positioning of the cylinder tube 12 in the axial direction (the direction of the arrow B) with respect to the head cover 14 is carried out, together with the other end side (in the direction of the arrow B), which is formed with a large diameter, being covered by the cylindrical body 24*a*.

In a state in which the cylinder tube 12 is positioned with respect to the head cover 14, an end of the cylindrical body 24*a* and another end of the head cover 14 are substantially coplanar (see FIG. 2A).

Further, a recess 36, which is circular shaped in cross section and is recessed diametrally inward, is formed at a small diameter location on the outer circumferential surface of the head cover 14. In the recess 36, a first fluid port 38 is formed through which a pressure fluid is supplied and discharged. The first fluid port 38 extends diametrally inward perpendicular to the axial direction of the head cover 14, and communicates with a first communication hole 40 that is formed in the center of the head cover 14. The recess 36 is exposed to the outer circumferential side through a port hole 42*a*, which is formed in the cylinder tube 12 that covers the outer circumferential side of the head cover 14. In addition, a fitting 44 (the two-dot-dashed line shape) is connected through the port hole 42*a* to the first fluid port 38, to and from which the pressure fluid is supplied and discharged through piping.

The first communication hole 40 opens in facing relation to the side of the cylinder tube 12 (in the direction of the arrow A) in the center in one end of the head cover 14. Together therewith, an end of the first communication hole 40 on the side of the cylinder chamber 22 (in the direction of the arrow A) expands in diameter, and a first damper 46 is mounted in the interior thereof. The first damper 46, for example, is formed in a ring shape from an elastic material, and is disposed such that the end thereof projects toward the side of the cylinder tube 12 (in the direction of the arrow A) slightly with respect to the end of the head cover 14.

On the other hand, an annular recess 48*a*, the diametral outer side of which is recessed in the axial direction (in the direction of the arrow A), is formed on the other end of the head cover 14. An outer circumferential side of the annular recess 48*a* is covered by the cylindrical body 24*a*, together with the latching ring 50 being held in the annular recess 48*a*. Further, multiple (for example, four) first attachment holes 52, which extend in the axial direction (the direction of the arrow A) at a location more on the inner circumferential side than the annular recess 48*a*, are formed in the other end of the head cover 14. The fluid pressure cylinder 10 can be fixed in place by screw-engagement of attachment bolts (not shown), which are inserted through another apparatus or the like, with respect to the first attachment holes 52. Moreover, the first attachment holes 52, for example, as shown in FIG. 2B, are disposed at equal intervals of separation mutually on a diameter that passes through the center of the head cover 14.

Further, the rotation preventing screw 30 that is inserted through the cylindrical body 24*a* is screw-engaged into the screw hole 32 that is formed in the outer circumferential surface of the head cover 14, whereby a state is brought about in which relative rotational displacement between the head cover 14 and the cylindrical body 24*a* and the cylinder tube 12 is restricted.

Figure 3B:
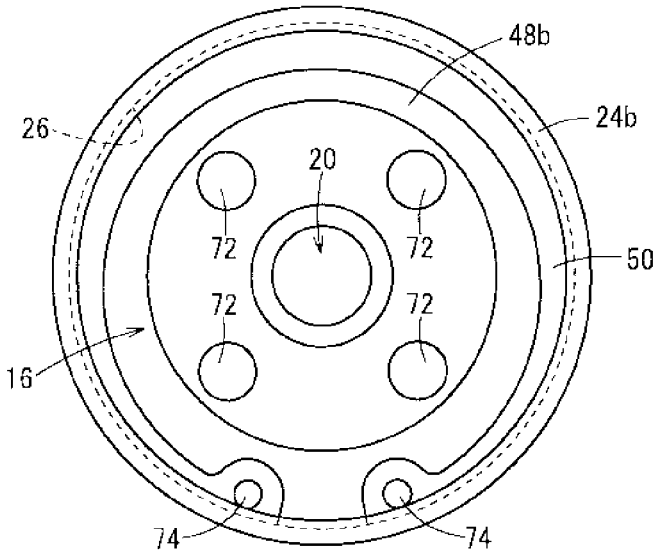
FIG. 3B is a front view in which the rod cover is observed from an axial direction.
Figure 4:
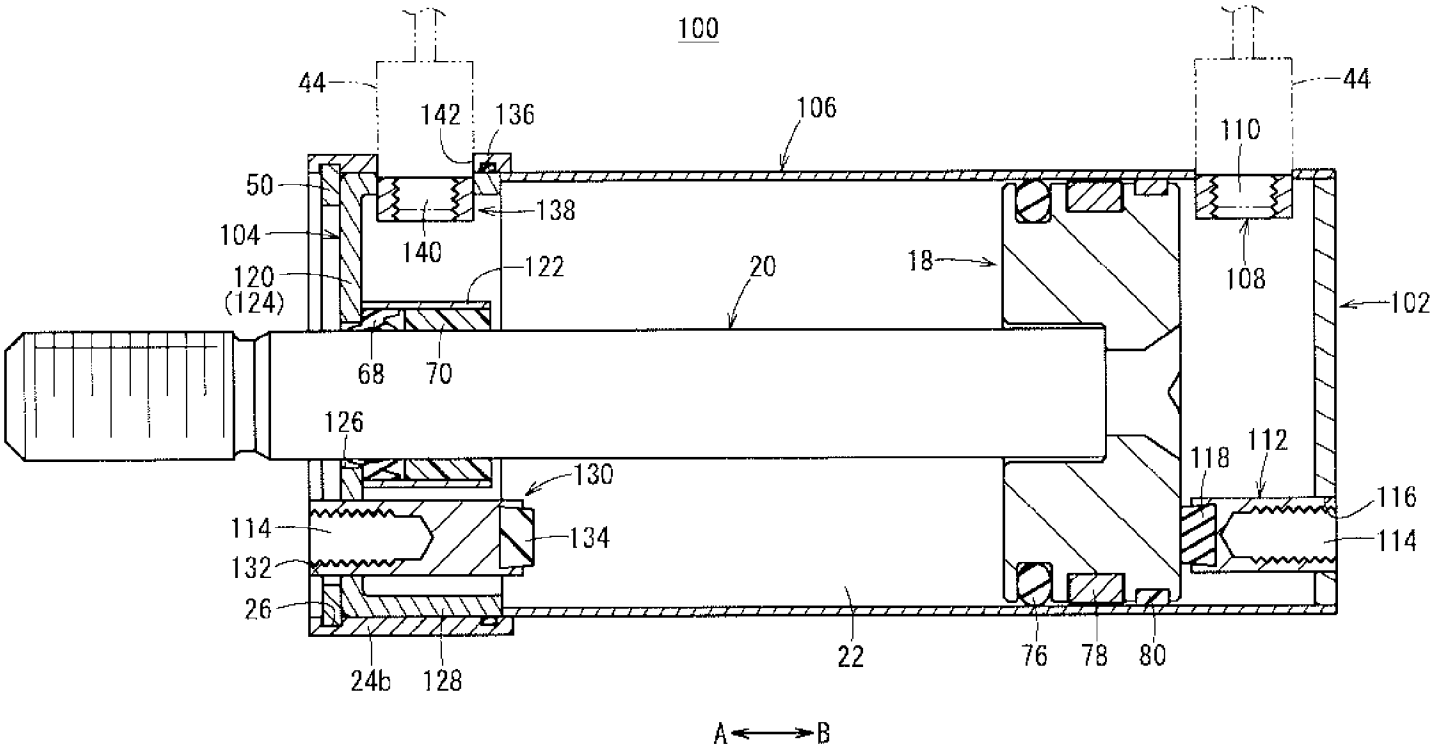
FIG. 4 is an overall cross-sectional view of a fluid pressure cylinder according to a second embodiment of the present invention.
Figure 5A:
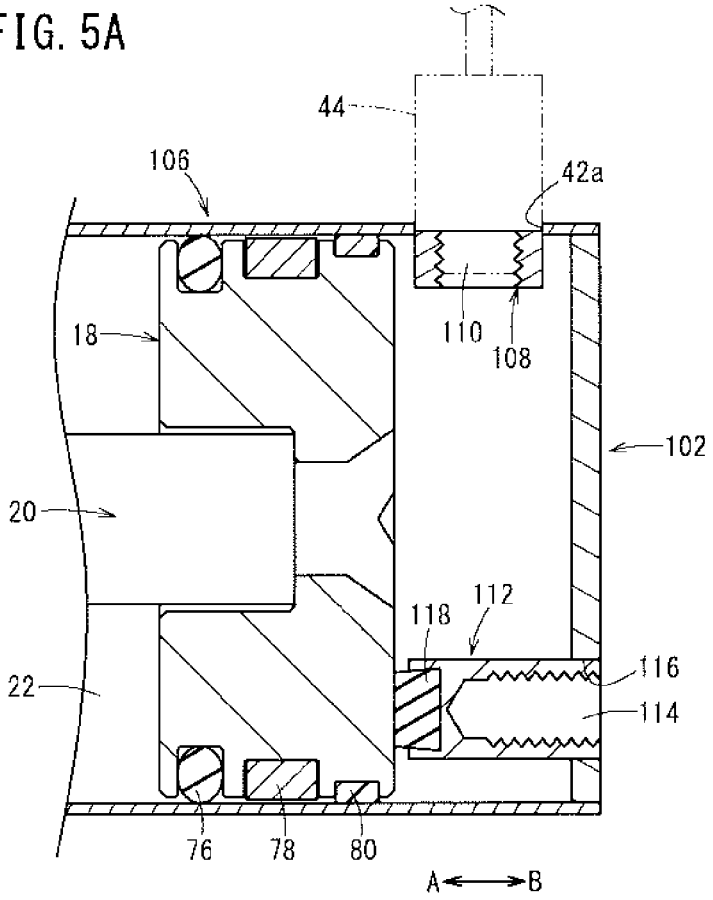
FIG. 5A is an enlarged cross-sectional view showing the vicinity of a head cover in the fluid pressure cylinder of FIG. 4.
Figure 5B:
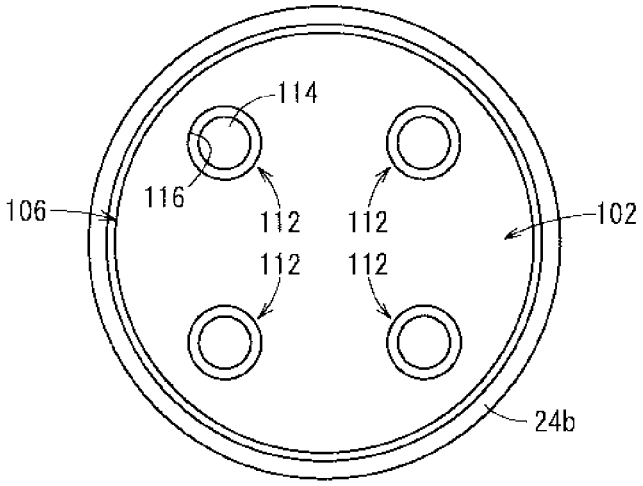
FIG. 5B is a front view in which the head cover is observed from an axial direction.
Figure 6A:
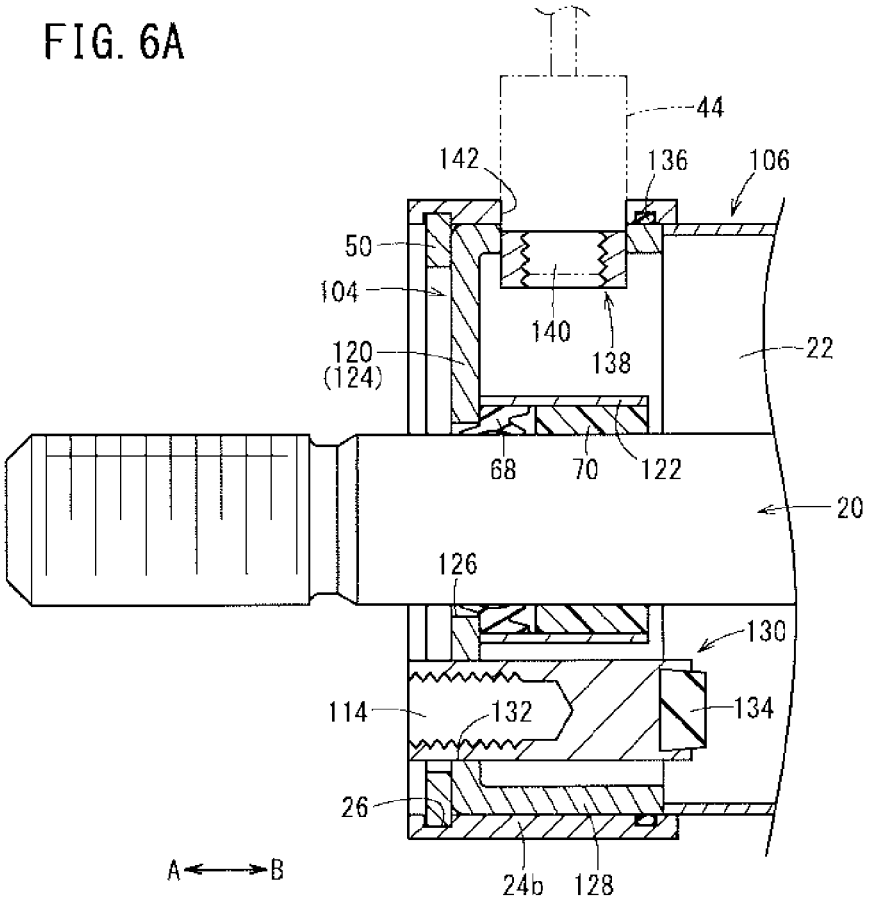
FIG. 6A is an enlarged cross-sectional view showing the vicinity of a rod cover in the fluid pressure cylinder of FIG. 4.
Figure 6B:
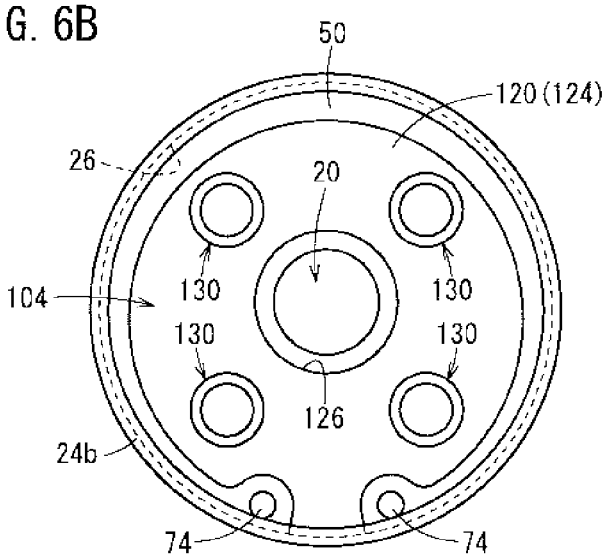
FIG. 6B is a front view in which the rod cover is observed from an axial direction.
Figure 7:
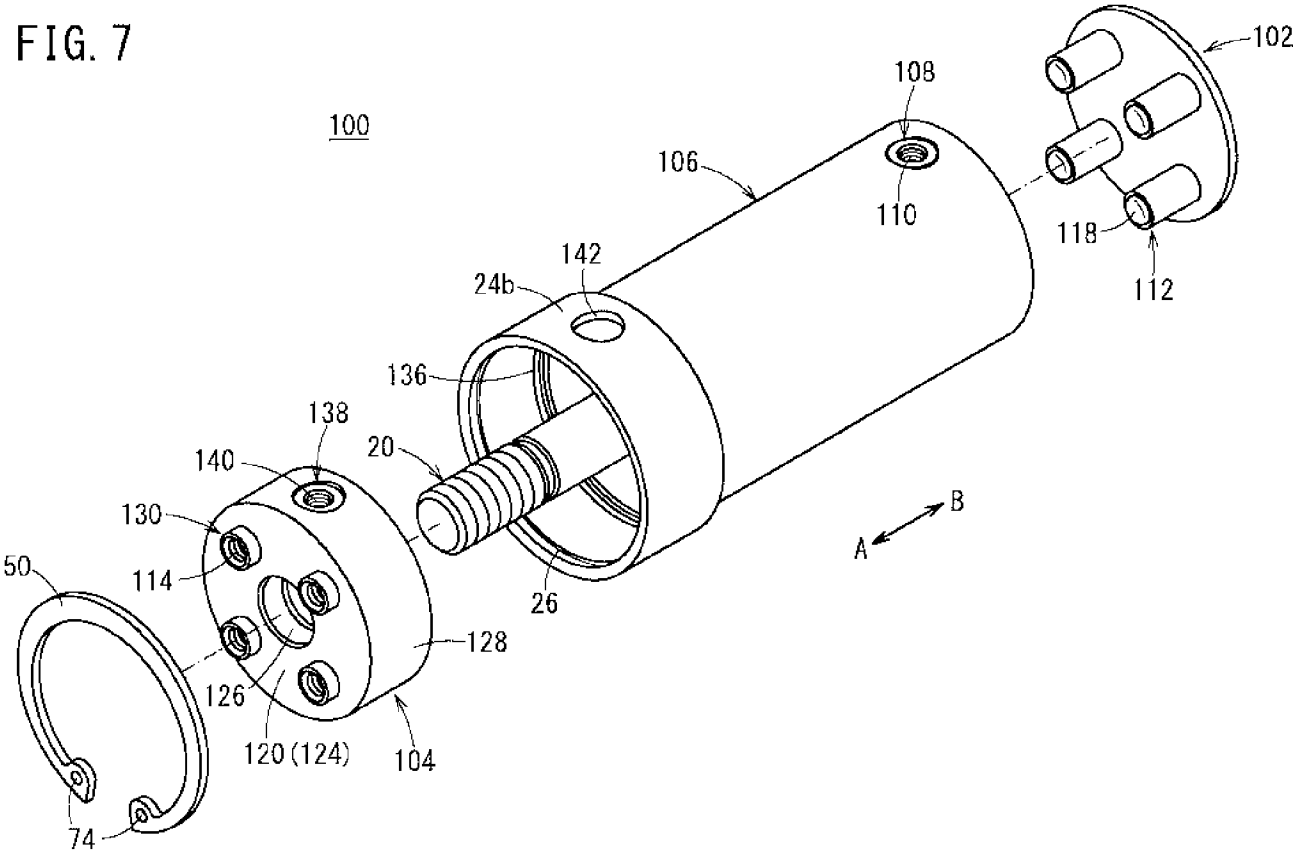
FIG. 7 is an exploded perspective view of the fluid pressure cylinder of FIG. 4.

As shown in FIGS. 1, 3A, and 3B, the rod cover 16, for example, is formed with a circular shape in cross section from a metal material such as stainless steel or the like, and is inserted into the interior of the cylinder tube 12 and the cylindrical body 24*b*.

The outer circumferential surface of the rod cover 16, in the same manner as the head cover 14, is formed in a stepwise shape, such that the other end side thereof (in the direction of the arrow A) expands slightly in diameter, and by abutment of the other end of the cylinder tube 12 against the stepped portion 56, positioning of the cylinder tube 12 in the axial direction (the direction of the arrow A) with respect to the rod cover 16 is carried out, together with the other end side (in the direction of the arrow A), which is formed with a large diameter, being covered by the cylindrical body 24*b*.

In a state in which the cylinder tube 12 is positioned with respect to the rod cover 16, an end of the cylindrical body 24*b* and another end of the rod cover 16 are substantially coplanar (see FIG. 3A).

Further, a recess 58, which is circular shaped in cross section and is recessed diametrally inward at a small diameter location, is formed on the outer circumferential surface of the rod cover 16. In the recess 58, a second fluid port 60 is formed through which a pressure fluid is supplied and discharged. The second fluid port 60 extends diametrally inward perpendicular to the axial direction of the rod cover 16, and communicates with a rod hole 62 and a second communication hole 64 that are formed in the center of the rod cover 16.

The recess 58 is exposed to the outer circumferential side through a port hole 42*b*, which is formed in the cylinder tube 12 that covers the outer circumferential side of the rod cover 16. In addition, a fitting 44 (the two-dot-dashed line shape) is connected through the port hole 42*b* to the second fluid port 60, to and from which the pressure fluid is supplied and discharged through piping.

The second communication hole 64 opens in facing relation to the side of the cylinder tube 12 (in the direction of the arrow B) in the center in one end of the rod cover 16, while additionally, the rod hole 62 that penetrates in the axial direction (the directions of arrows A and B) is formed in the center of the second communication hole 64. Further, an end of the second communication hole 64 on the side of the cylinder chamber 22 (in the direction of the arrow B) expands in diameter, and a second damper 66 is mounted in the interior thereof. The second damper 66, for example, is formed in a ring shape from an elastic material, and is disposed such that the end thereof projects toward the side of the cylinder tube 12 (in the direction of the arrow B) slightly with respect to the end of the rod cover 16.

A rod packing 68 and a bush 70 are disposed through annular grooves in the rod hole 62, and by sliding respectively along the outer circumferential surface of the piston rod 20, leakage of pressure fluid from between the piston rod 20 and the rod cover 16 is prevented, while in addition, the piston rod 20 is guided along the axial direction (the directions of arrows A and B).

On the other hand, an annular recess 48*b*, the diametral outer side of which is recessed in the axial direction (in the direction of the arrow B) is formed on the other end of the rod cover 16. An outer circumferential side of the annular recess 48*b* is covered by the cylindrical body 24*b*, together with the latching ring 50 being held in the annular recess 48*b*.

Further, multiple (for example, four) second attachment holes 72, which extend in the axial direction (the direction of the arrow B) at a location more on the inner circumferential side than the annular recess 48*b*, are formed in the other end of the rod cover 16. The fluid pressure cylinder 10 can be fixed in place by screw-engagement of attachment bolts (not shown), which are inserted through another apparatus or the like, with respect to the second attachment holes 72. Moreover, the second attachment holes 72, for example, as shown in FIG. 3B, are disposed at equal intervals of separation mutually on a diameter that passes through the center of the rod cover 16.

Furthermore, the rotation preventing screw 30 that is inserted through the cylindrical body 24*b* is screw-engaged into the screw hole 32 that is formed in the outer circumferential surface of the rod cover 16, whereby a state is brought about in which relative rotational displacement between the rod cover 16 and the cylindrical body 24*b* and the cylinder tube 12 is restricted.

The latching rings 50, for example, are formed substantially with C-shapes in cross section from a metal material, and are mounted respectively in the engagement grooves 26 that are formed in the cylindrical bodies 24*a*, 24*b*. The latching rings 50 are formed in shapes corresponding to the engagement grooves 26 and have elastic forces so as to expand diametrally outward. Together therewith, jig holes 74 are formed respectively at locations that are expanded diametrally inward on open ends thereof.

Additionally, by a non-illustrated jig being inserted into the pair of jig holes 74, and by the expanded parts with the jig holes 74 being displaced in directions to approach one another mutually, the latching rings 50 can be deformed elastically and diametrally inwardly in opposition to the elastic force of the latching rings 50.

In a state in which the head cover 14 and the rod cover 16 are inserted through the interiors of the cylindrical bodies

24*a*, 24*b* and the cylinder tube 12, and the one end and the other end of the cylinder tube 12 are placed in abutment with the stepped portions 34, 56 and positioned in the axial direction, the latching rings 50 are engaged respectively in the engagement grooves 26 of the cylindrical bodies 24*a*, 24*b*. As a result, the latching rings 50 abut against the wall surfaces of the annular recesses 48*a*, 48*b* of the head cover 14 and the rod cover 16, and disengagement of the head cover 14 and the rod cover 16 from the open-ended sides of the cylindrical bodies 24*a*, 24*b* is restricted.

Stated otherwise, the latching rings 50 function as latching members for fixing the head cover 14 and the rod cover 16 with respect to the cylinder tube 12.

As shown in FIGS. 1 and 2A, the piston 18 is formed with a circular shape in cross section, and is accommodated in the cylinder chamber 22 displaceably along the axial direction (in the directions of arrows A and B), together with a piston packing 76, a magnet 78, and a wear ring 80 being disposed respectively through annular grooves on the outer circumferential surface of the piston 18. Further, one end of the piston rod 20, which is inserted through a central portion of the piston 18, is connected integrally with the piston 18 by caulking.

In addition, by the piston packing 76 being placed in abutment with the inner circumferential surface of the cylinder tube 12, leakage of pressure fluid from between the piston 18 and the cylinder tube 12 is prevented, and by abutment of the wear ring 80 against the inner circumferential surface of the cylinder tube 12, the piston 18 is guided along the axial direction. Further, magnetism of the magnet 78 is detected by a position detecting sensor, which is provided on an outer side of the cylinder tube 12, whereby the position of the piston 18 in the interior of the cylinder tube 12 can be detected.

The piston rod 20 is made up from a shaft having a predetermined length in the axial direction (the directions of arrows A and B). One end of the piston rod 20 is connected to the center of the piston 18, whereas the other end thereof projects to the exterior of the fluid pressure cylinder 10 through the rod hole 62 of the rod cover 16.

The fluid pressure cylinder 10 according to the first embodiment of the present invention is constructed basically as described above. Next, a case in which the head cover 14 is assembled with respect to the cylinder tube 12 will be described while referring to FIGS. 1 and 2A.

Since assembly of the rod cover 16 with respect to the cylinder tube 12 is roughly the same as the case of the head cover 14, detailed description of the case of the rod cover 16 will be omitted.

First, the head cover 14 is inserted into the interior of the opened cylinder tube 12 from one end side (in the direction of the arrow B), and by abutment of the stepped portion 34 thereof against the one end of the cylinder tube 12, a positioned state is brought about in which further movement of the head cover 14 toward the other end side of the cylinder tube 12 (in the direction of the arrow A) is restricted. In the positioned state, a condition is provided in which the annular recess 48*a* of the head cover 14 is covered by the cylindrical body 24*a*.

Next, by a non-illustrated jig, which is inserted into the pair of jig holes 74, in a state in which the latching ring 50 is elastically deformed diametrally inward, the head cover 14 is inserted into the annular recess 48*a*, and in a state in which a portion thereof is inserted into the engagement groove 26, the deformed state of the jig is released. Consequently, the latching ring 50 is expanded in diameter by the elasticity thereof and engages with the engagement groove 26, whereby a condition is brought about in which movement of the head cover 14 in a direction (the direction of the arrow B) away from the cylinder tube 12 is restricted by the latching ring 50 that is engaged with the cylindrical body 24*a*.

More specifically, since movement of the head cover 14 toward the side of the rod cover 16 (in the direction of the arrow A) is restricted by abutment of the stepped portion 34 with respect to the cylinder tube 12, and since movement thereof in a direction away from the rod cover 16 (in the direction of the arrow B) is restricted by the latching ring 50, a fixed state is established in which displacement of the head cover 14 in the axial direction (the directions of arrows A and B) with respect to the end of the cylinder tube 12 is restricted.

Lastly, the screw hole 32 of the head cover 14 and the hole 28 of the cylindrical body 24*a* are placed in matching relation, and by insertion and screw-rotation of the rotation preventing screw 30 from the outer circumferential side, rotation of the head cover 14 with respect to the cylindrical body 24*a* and the cylinder tube 12 is restricted. Stated otherwise, by the rotation preventing screw 30, the head cover 14 is positioned in the circumferential direction with respect to the cylindrical body 24*a*. Consequently, the port hole 42*a* that opens on the outer circumferential surface of the cylinder tube 12 is positioned in facing relation to the first fluid port 38.

As a result, assembly of the head cover 14 with respect to one end of the cylinder tube 12 is completed.

On the other hand, in the case that the head cover 14 is to be removed from the cylinder tube 12, first, the rotation preventing screw 30 is rotated, and the rotation preventing screw 30 is taken out from the head cover 14 and the cylindrical body 24*a*. Together therewith, using the non-illustrated jig, the latching ring 50 is elastically deformed diametrally inward, and is taken out from the engagement groove 26. Owing thereto, the head cover 14 is released from its fixed state with respect to the cylinder tube 12, whereby the head cover 14 can be moved and taken out in a direction (the direction of the arrow B) to separate away from the cylinder tube 12.

Next, operations of the fluid pressure cylinder 10, which is assembled as described above, will be explained. The condition shown in FIG. 1, in which the piston 18 is moved to the side of the head cover 14 (in the direction of the arrow B), will be described as an initial condition.

First, a pressure fluid is supplied to the first fluid port 38 from a non-illustrated pressure fluid supply source. In this case, the second fluid port 60 is placed beforehand in a state of being open to atmosphere under a switching action of a non-illustrated switching valve. Accordingly, the pressure fluid is supplied to the first communication hole 40 from the first fluid port 38, and by the pressure fluid that is supplied into the cylinder chamber 22 from the first communication hole 40, the piston 18 is pressed toward the side of the rod cover 16 (in the direction of the arrow A). In addition, under the displacement action of the piston 18, the piston rod 20 is displaced together with the piston 18, and a displacement end position is reached by the piston 18 coming into abutment against the second damper 66.

Next, in the case that the piston 18 is to be displaced in an opposite direction (in the direction of the arrow B), the pressure fluid is supplied to the second fluid port 60, together with the first fluid port 38 being opened to atmosphere under a switching action of a non-illustrated switching valve. In addition, the pressure fluid is supplied into the cylinder chamber 22 from the second fluid port 60 through the second communication hole 64, whereupon the piston 18 is pressed by the pressure fluid that is supplied into the cylinder chamber 22 toward the side of the head cover 14 (in the direction of the arrow B).

Consequently, under the displacement action of the piston 18, the piston rod 20 is displaced together with the piston 18, and the initial position is restored (see FIG. 1) by the piston 18 coming into abutment against the first damper 46 of the head cover 14.

In the foregoing manner, according to the first embodiment, in the fluid pressure cylinder 10, the recesses 36, 58, which are recessed diametrally inward with respect to the outer circumferential surfaces of the head cover 14 and the rod cover 16, are provided, and the first and second fluid ports 38, 60 open inside the recesses 36, 58. Therefore, the amount by which the fittings 44 and pipings, etc., that are connected to the first and second fluid ports 38, 60 project can be suppressed. As a result, compared to the conventional fluid pressure cylinder in which the ports project out diametrally with respect to the cylinder tube 12, the fluid pressure cylinder 10 can be reduced in size in the diametral direction, and the space on the outer circumferential side of the fluid pressure cylinder 10 can be utilized effectively.

Further, a structure is provided in which the head cover 14 and the rod cover 16 are capable of being fixed by the latching rings 50, which can be engaged with respect to the cylindrical bodies 24*a*, 24*b* provided on both ends of the cylinder tube 12. Therefore, compared to the conventional fluid pressure cylinder in which the head cover and the rod cover are affixed by being screw-engaged with respect to both ends of the cylinder tube, since there is no need to provide threaded portions, respectively, for the purpose of mutual screw-engagement between the cylinder tube 12 and the head cover 14 and the rod cover 16, the longitudinal dimension of the fluid pressure cylinder 10 in the axial direction can be reduced in size significantly.

Furthermore, compared to the conventional fluid pressure cylinder in which the head cover and the rod cover are connected by being screw-engaged with respect to both ends of the cylinder tube, the operation to attach and detach the head cover 14 and the rod cover 16 with respect to the cylinder tube 12 can be performed easily, simply by installation and removal of the latching rings 50.

Next, a fluid pressure cylinder 100 according to a second embodiment is shown in FIGS. 4 through 7. Constituent elements, which are the same as those of the above-described fluid pressure cylinder 10 according to the first embodiment, are denoted by the same reference characters, and detailed description of such features is omitted.

The fluid pressure cylinder 100 according to the second embodiment differs from the fluid pressure cylinder 10 according to the first embodiment, in that a head cover 102 and a rod cover 104 are formed from plate members.

As shown in FIGS. 4 through 6B, the fluid pressure cylinder 100 comprises a plate-shaped head cover 102 that closes one end of a cylinder tube 106, and the cylindrical shaped rod cover 104 that closes the other end of the cylinder tube 106.

The head cover 102 is disposed in the interior of one end of the cylinder tube 106, and a port hole 42*a* opens on an outer circumferential surface of another end side (in the direction of the arrow A), which is separated a predetermined distance from the one end thereof. In the interior of the cylinder tube 106, a first port member 108 that faces toward the port hole 42*a* is fixed by welding or the like. The first port member 108 includes in the interior a first fluid port 110 with threads engraved thereon, and a fitting 44 (the two-dot-dashed line shape) is connected to the first port member 108. More specifically, the first port member 108 is disposed so as to project diametrally inward with respect to the cylinder tube 106.

Meanwhile, on the other end of the cylinder tube 106, in which the rod cover 104 is disposed in the interior thereof, a cylindrical body 24*b* is welded on the outer circumferential surface thereof, together with a port hole 142 opening at a position on the one end side (in the direction of the arrow B) of the cylinder tube 106 with respect to an end of the cylindrical body 24*b*.

The head cover 102, for example, is formed with a circular disk shape of a constant thickness from a metal material such as stainless steel or the like, which is inserted into the one end of the cylinder tube 106, and is fixed thereto by welding or the like. Further, on the head cover 102, multiple (for example, four) first boss members 112 are provided at positions on predetermined diameters with respect to the center of the head cover 102.

The first boss members 112 are formed in cylindrical shapes with screw holes 114 being formed in the interior thereof, and are inserted into holes 116 that are formed in the head cover 102. Ends of the first boss members 112 are fixed by welding or the like in a coplanar state with the end surface of the head cover 102. More specifically, the first boss members 112 are disposed so as to project toward the side of the cylinder tube 106 (in the direction of the arrow A) with respect to the head cover 102.

Further, first dampers 118 made from an elastic material such as rubber or the like are disposed respectively on the other ends of the first boss members 112, and are arranged in facing relation to the cylinder chamber 22.

In addition, the screw holes 114 of the first boss members 112 function as attachment holes, which are used when the fluid pressure cylinder 100 is fixed to another apparatus or the like.

The rod cover 104 includes a main body portion 120, which is formed, for example, from a metal material such as stainless steel or the like and has a U-shape in cross section, and a cylindrical shaped holder portion 122 provided in the center of the main body portion 120. The main body portion 120 has a rod hole 126 formed in the center of a base part 124 that is formed in a disk shape and through which the piston rod 20 is inserted. An end of the holder portion 122 is joined by welding or the like so as to be coaxial with the rod hole 126. More specifically, the holder portion 122 is formed substantially in parallel with a circumferential wall portion 128 that extends in an axial direction from the outer edge of the base part 124 in the main body portion 120.

Further, multiple (for example, four) second boss members 130 are provided at positions on predetermined diameters centrally about the rod hole 126 on the base part 124 of the main body portion 120.

The second boss members 130 are formed in cylindrical shapes with the screw holes 114 being formed in the interior thereof, and are inserted into holes 132 that are formed in the rod cover 104. Ends of the second boss members 130 are fixed by welding or the like in a coplanar state with the end surface of the rod cover 104. More specifically, the second boss members 130 are disposed so as to project toward the side of the cylinder tube 106 (in the direction of the arrow B) with respect to the rod cover 104.

Further, second dampers 134 made from an elastic material such as rubber or the like are disposed respectively on the other ends of the second boss members 130, and are arranged in facing relation to the cylinder chamber 22.

In addition, the screw holes 114 of the second boss members 130 function as attachment holes, which are used when the fluid pressure cylinder 100 is fixed to another apparatus or the like.

Further, the circumferential wall portion 128 on the main body portion 120 is accommodated so as to be capable of sliding along the inner circumferential surface of the cylindrical body 24*b*, and by abutting against a seal ring 136 that is provided on the inner circumferential surface of the cylindrical body 24*b*, leakage of pressure fluid passing between the cylinder tube 106 and the rod cover 104 is prevented.

A second port member 138 is disposed so as to penetrate in a diametral direction on the circumferential wall portion 128. The second port member 138 does not project diametrally outward with respect to the circumferential wall portion 128, and is fixed integrally by welding or the like in a state of projecting diametrally inward.

The second port member 138 includes in the interior thereof a second fluid port 140 on which screw threads are engraved, and in a state in which the rod cover 104 is disposed in the interior of the cylinder tube 106, the second port member 138 is arranged in facing relation to the port hole 142 of the cylindrical body 24*b*, and a fitting 44 is connected thereto through the port hole 142. Moreover, the fitting 44 is connected to the second port member 138 through the port hole 142, whereby relative rotational displacement between the rod cover 104 and the cylindrical body 24*b* is restricted.

On the other hand, in the interior of the holder portion 122, a rod packing 68 and a bush 70 are disposed along the axial direction.

In addition, the rod cover 104 is inserted into the interior of the cylindrical body 24*b*, and in a state of being positioned axially by abutment of the end of the circumferential wall portion 128 against the other end of the cylinder tube 106, and by the latching ring 50 being engaged in the engagement groove 26 of the cylindrical body 24*b*, the latching ring 50 abuts against the base part 124 of the rod cover 104, and disengagement of the rod cover 104 from the open end side of the cylindrical body 24*b* is restricted.

Because the operations of the fluid pressure cylinder 100 according to the second embodiment are the same as the operations of the fluid pressure cylinder 10 according to the first embodiment, detailed descriptions of such operations are omitted.

As has been described above, with the fluid pressure cylinder 100 according to the second embodiment, by the head cover 102 and the rod cover 104, which are disposed on both ends of the cylinder tube 106, being formed from plate members, compared to the conventional fluid pressure cylinder in which the head cover and the rod cover are affixed by being screw-engaged with respect to both ends of the cylinder tube, there is no need to provide threaded portions, respectively, for the purpose of mutual screw-engagement between the cylinder tube 106 and the head cover 102 and the rod cover 104. Therefore, the longitudinal dimension of the fluid pressure cylinder 100 in the axial direction can be reduced in size.

Further, by the first and second port members 108, 138 through which the pressure fluid is supplied and discharged being disposed on the inner circumferential side of the cylinder tube 106, compared to the conventional fluid pressure cylinder in which the ports project diametrally outward with respect to the cylinder tube, the diametral dimension of the fluid pressure cylinder 100 can be made smaller in size.

Furthermore, compared to the conventional fluid pressure cylinder in which the rod cover is connected by being screw-engaged with respect to the cylinder tube, the operation to attach and detach the rod cover 104 with respect to the cylinder tube 106 can be performed easily, simply by installation and removal of the latching ring 50. Moreover, with the aforementioned fluid pressure cylinder 100, although a configuration is provided in which only the rod cover 104 is attachable and detachable with respect to the cylinder tube 106, by providing a latching ring 50 also on the side of the head cover 102, a configuration may be provided in which the head cover 102 also is attachable and detachable with respect to the cylinder tube 106.

Further still, since the head cover 102 and the rod cover 104 are formed from plate members having a predetermined thickness, compared to the fluid pressure cylinder 10 according to the first embodiment, a significant reduction in weight can also be achieved.

Next, a fluid pressure cylinder 150 according to a third embodiment is shown in FIGS. 8 through 11. Constituent elements, which are the same as those of the above-described fluid pressure cylinders 10 and 100 according to the first and second embodiments, are denoted by the same reference characters, and detailed description of such features is omitted.

Figure 8:
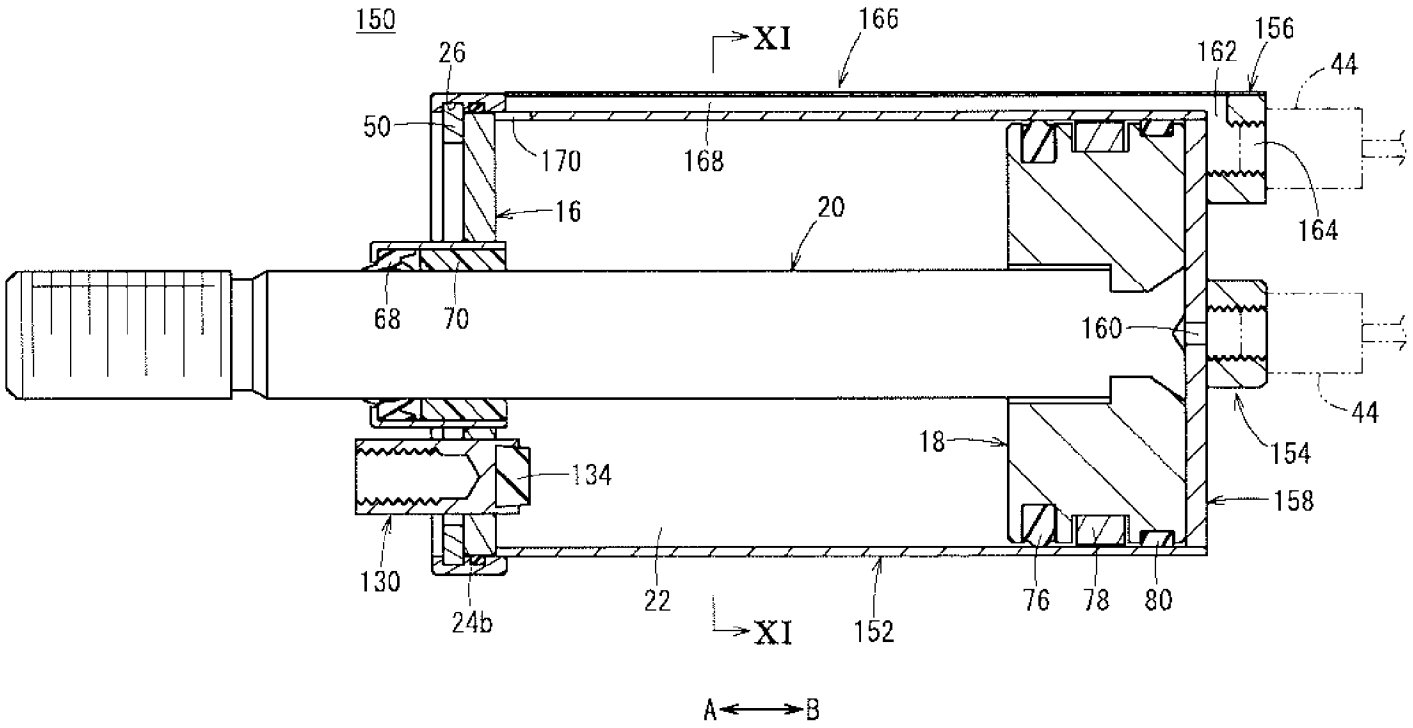
FIG. 8 is an overall cross-sectional view of a fluid pressure cylinder according to a third embodiment of the present invention.

As shown in FIG. 8, the fluid pressure cylinder 150 according to the third embodiment differs from the fluid pressure cylinder 100 according to the second embodiment, in that first and second port members 154, 156, which extend in the axial direction of a cylinder tube 152, are provided respectively on an end part of a head cover (cover member) 158.

Figure 9:
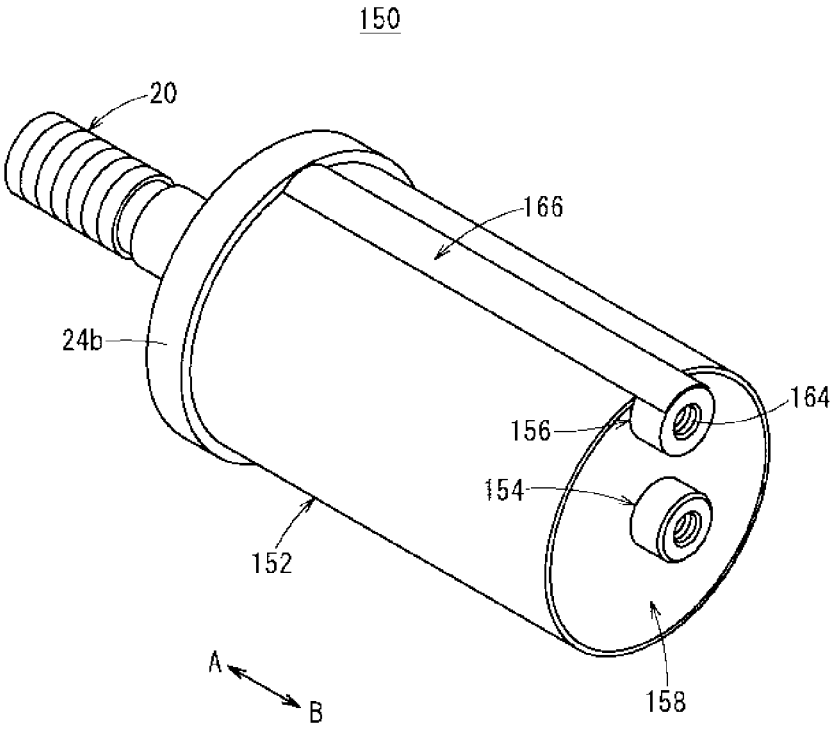
FIG. 9 is an exterior perspective view of the fluid pressure cylinder shown in FIG. 8.
Figure 10:
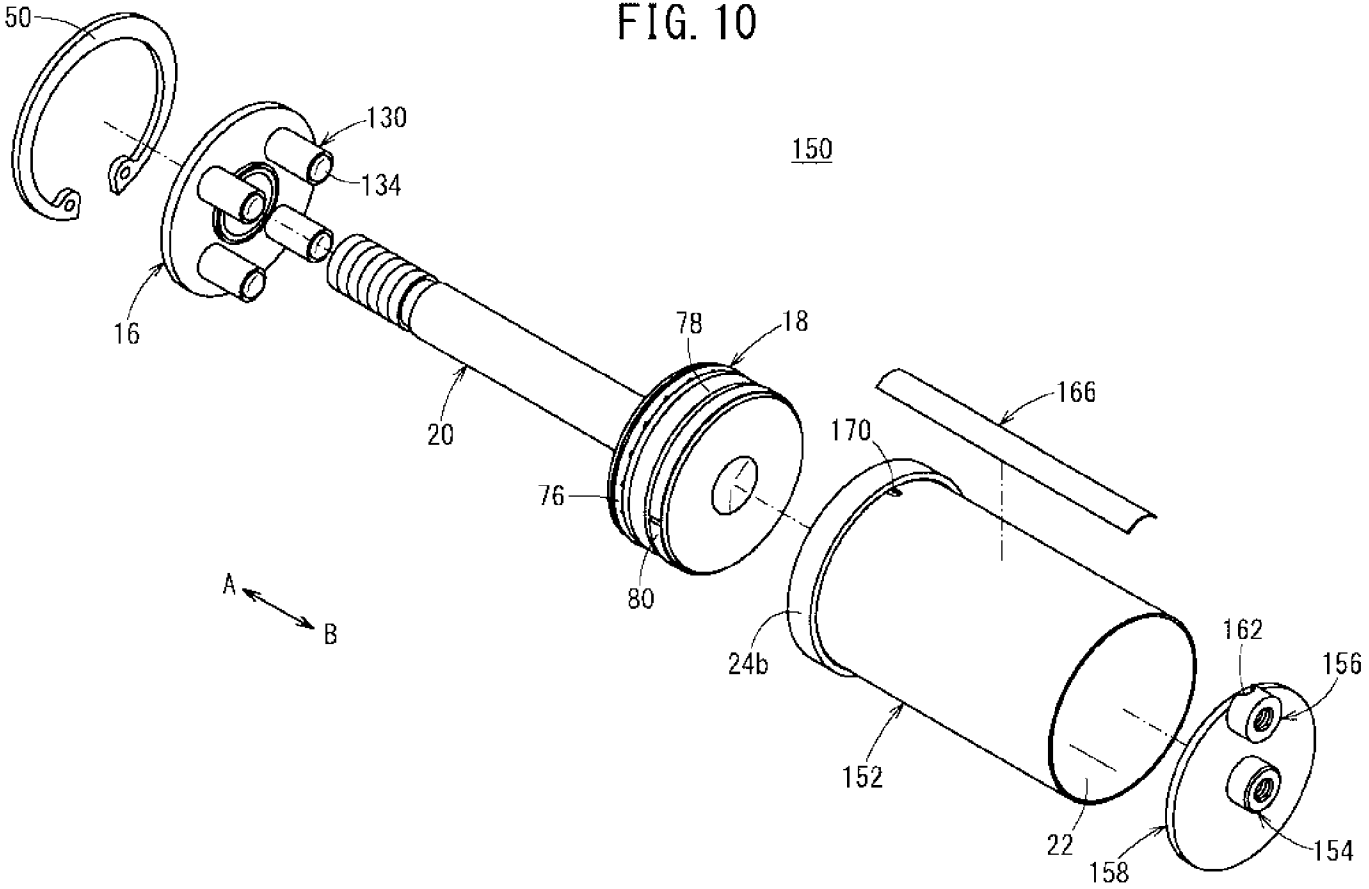
FIG. 10 is an exploded perspective view of the fluid pressure cylinder shown in FIG. 9.

As shown in FIGS. 8 through 10, in the fluid pressure cylinder 150, one end of the cylinder tube 152 is closed by the plate-shaped head cover 158, and a first communication hole 160 that penetrates in the axial direction is formed in the center thereof, together with the first port member 154 being provided that communicates with the first communication hole 160.

The first port member 154 is formed in a cylindrical shape, and is disposed along the axial direction (the directions of arrows A and B) of the cylinder tube 152, with an end thereof being fixed by welding or the like to an end surface of the head cover 158. In addition, a fitting 44 (the two-dot-dashed line shape) is connected to the first port member 154, to and from which the pressure fluid is supplied and discharged through piping, and the first port member 154 communicates through the first communication hole 160 with the cylinder chamber 22.

Further, in the vicinity of an outer edge of the disk-shaped head cover 158, the second port member 156 is disposed so as to extend along the axial direction of the cylinder tube 152, with an end thereof being fixed by welding or the like to an end surface of the head cover 158. More specifically, the first and second port members 154, 156 are disposed substantially in parallel on the head cover 158, and are disposed so as to project at a predetermined height in a direction (the direction of the arrow B) away from the head cover 158.

The second port member 156 is disposed so as to project diametrally outward beyond the outer circumferential surface of the cylinder tube 152, and in the vicinity of the end thereof that is fixed to the head cover 158, a through hole 162 is formed that penetrates diametrally outward (see FIGS. 8 and 10). The through hole 162 communicates on a diametral inner side with a port hole 164 of the second port member 156 through which fluid is supplied and discharged.

In addition, at an outer circumferential location of the second port member 156 located maximally on the diametral outer side thereof, a passage member 166 is mounted in covering relation to the through hole 162.

The passage member 166 is formed with an arcuate shape in cross section by press molding a plate member, for example, and has a predetermined length extending along the axial direction (the directions of arrows A and B). In addition, one end of the passage member 166 is fixed by welding or the like in a state of covering the outer circumferential surface of the second port member 156 in facing relation to the through hole 162. Together therewith, the other end of the passage member 166 is connected by welding or the like to a location of the cylindrical body 24*b*, which is disposed on the side of the rod cover 16 (in the direction of the arrow A).

Figure 11:
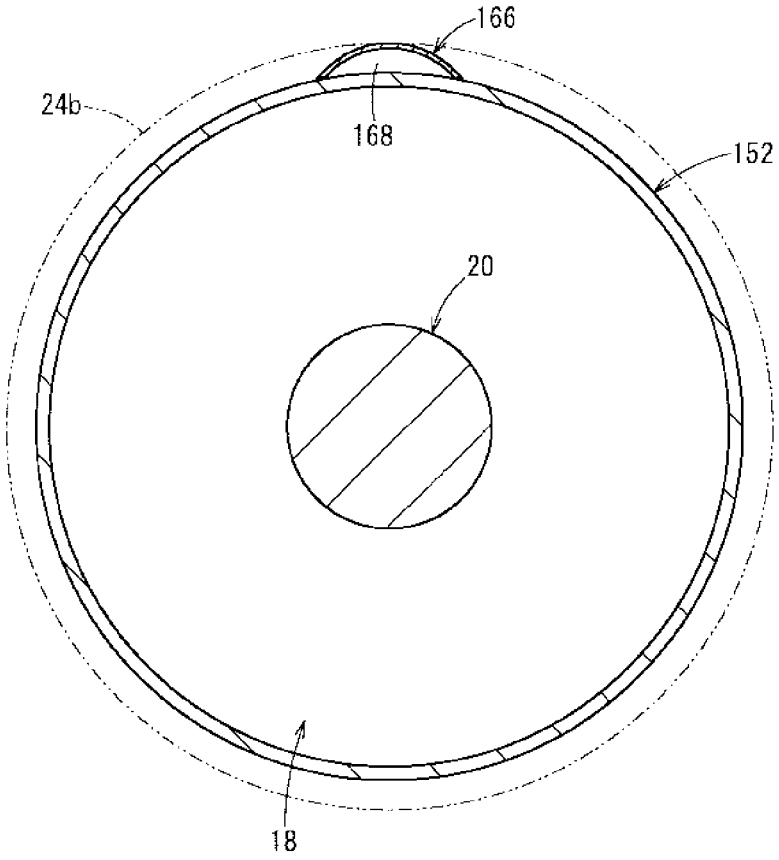
FIG. 11 is a cross-sectional view taken along line XI-XI of FIG. 8.

Further, a location midway between the one end and the other end of the passage member 166 is affixed by welding or the like in a state of abutment against the outer circumferential surface of the cylinder tube 152. Additionally, as shown in FIGS. 8 and 11, a space surrounded by the passage member 166 and an outer circumferential surface of the cylinder tube 152 makes up a flow path 168 through which the pressure fluid flows. One end of the flow path 168 communicates with the through hole 162 of the second port member 156, whereas the other end communicates with the cylinder chamber 22 through a second communication hole 170 that opens on the outer circumferential surface of the cylinder tube 152.

Moreover, in the flow path 168, airtightness is maintained by welding the cylinder tube 152 and the passage member 166 continuously along the axial direction (the directions of arrows A and B), such that the pressure fluid does not leak out to the exterior.

Further, as shown in FIG. 11, the passage member 166 does not project diametrally outward beyond the outer circumferential surface of the cylindrical body 24*b*, which is greatest in terms of its outside diameter on the fluid pressure cylinder 150. More specifically, by providing the first and second port members 154, 156 along the axial direction on the head cover 158, an increase in size in the diametral direction is avoided, without changing the maximum outer diameter of the fluid pressure cylinder 150.

Furthermore, the passage member 166 is not limited to being fixed by welding with respect to the cylinder tube 152, the second port member 156, and the cylindrical body 24*b*, and for example, may be fixed by bonding, fusion welding, or the like.

Next, operations of the fluid pressure cylinder 150 according to the above-described third embodiment will be described. The condition shown in FIG. 8, in which the piston 18 is moved foremost to the side of the head cover 158 (in the direction of the arrow B), will be described as an initial condition.

First, a pressure fluid is supplied through piping and the fitting 44 to the first port member 154 from a non-illustrated pressure fluid supply source. In this case, the second port member 156 is placed beforehand in a state of being open to atmosphere under a switching action of a non-illustrated switching valve. Accordingly, the pressure fluid passes through the first communication hole 160 and is supplied from the first port member 154 to the cylinder chamber 22, whereupon the piston 18 is pressed by the pressure fluid toward the side of the rod cover 16 (in the direction of the arrow A). In addition, under the displacement action of the piston 18, the piston rod 20 is displaced together with the piston 18, and a displacement end position is reached by the piston 18 coming into abutment against the second damper 134.

Next, in the case that the piston 18 is to be displaced in an opposite direction (in the direction of the arrow B), the pressure fluid is supplied to the second port member 156, together with the first port member 154 being opened to atmosphere under a switching action of a non-illustrated switching valve.

In addition, the pressure fluid passes through the through hole 162 and flows from the port hole 164 of the second port member 156 into the flow path 168 that is formed in the interior of the passage member 166, and then, after having flowed along the flow path 168 to the side of the rod cover 16 (in the direction of the arrow A), the pressure fluid passes through the second communication hole 170 and is supplied to the interior of the cylinder chamber 22. The piston 18 is pressed by the pressure fluid that is supplied into the cylinder chamber 22 toward the side of the head cover 158 (in the direction of the arrow B).

Consequently, under the displacement action of the piston 18, the piston rod 20 is displaced together with the piston 18, and the initial position is restored (see FIG. 8) by the piston 18 coming into abutment against the head cover 158.

As has been described above, with the fluid pressure cylinder 150 according to the third embodiment, the first and second port members 154, 156 through which the pressure fluid is supplied and discharged are disposed on the head cover 158, which is provided on one end of the cylinder tube 152, together with being disposed so as to extend along the axial direction (the direction of the arrow B) of the cylinder tube 152. For this reason, the first and second port members 154, 156 do not project diametrally outward from the outer circumferential surface of the cylindrical body 24*b*, which has the greatest outside diameter. Further, at the same time, the fittings 44 and pipings connected to the first and second port members 154, 156 are not disposed in a diametrally outwardly arranged layout.

As a result, the diametral dimension of the fluid pressure cylinder 150 can be reduced in size, along with enabling the pipings to be connected to the first and second port members 154, 156 that are disposed in the axial direction. Thus, for example, in an installation environment for the fluid pressure cylinder 150, even if there is no margin of space available on the diametral outer side of the fluid pressure cylinder 150, it is still possible for the fluid pressure cylinder 150 to be easily arranged and utilized.

Further, the first and second port members 154, 156 are not limited to being separate bodies that are fixed with respect to the head cover 158, as in the above-described fluid pressure cylinder 150. For example, the head cover 158 may be formed with a certain thickness in the axial direction (the directions of arrows A and B), and first and second port members (port holes) may be formed directly therein along the axial direction.

Figure 12:
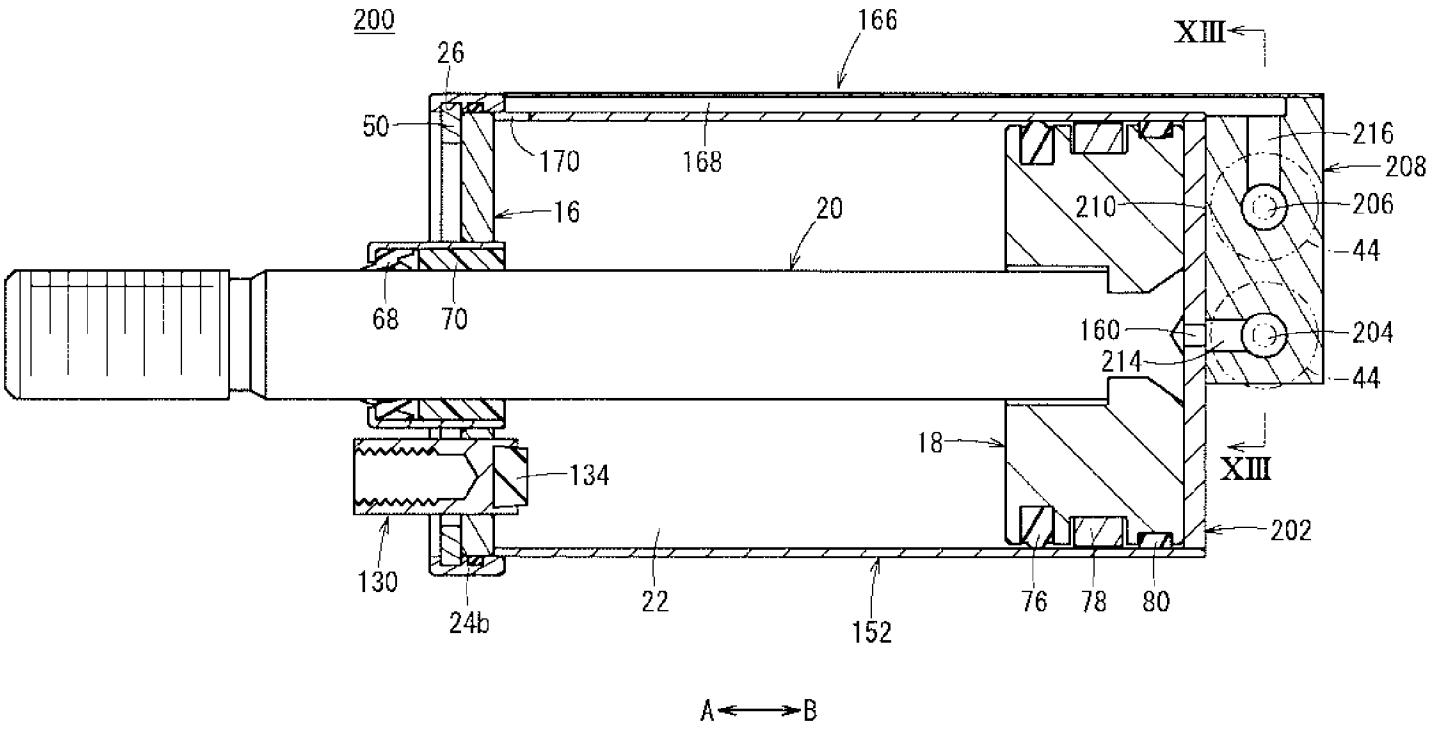
FIG. 12 is an overall cross-sectional view of a fluid pressure cylinder according to a fourth embodiment of the present invention.
Figure 13:
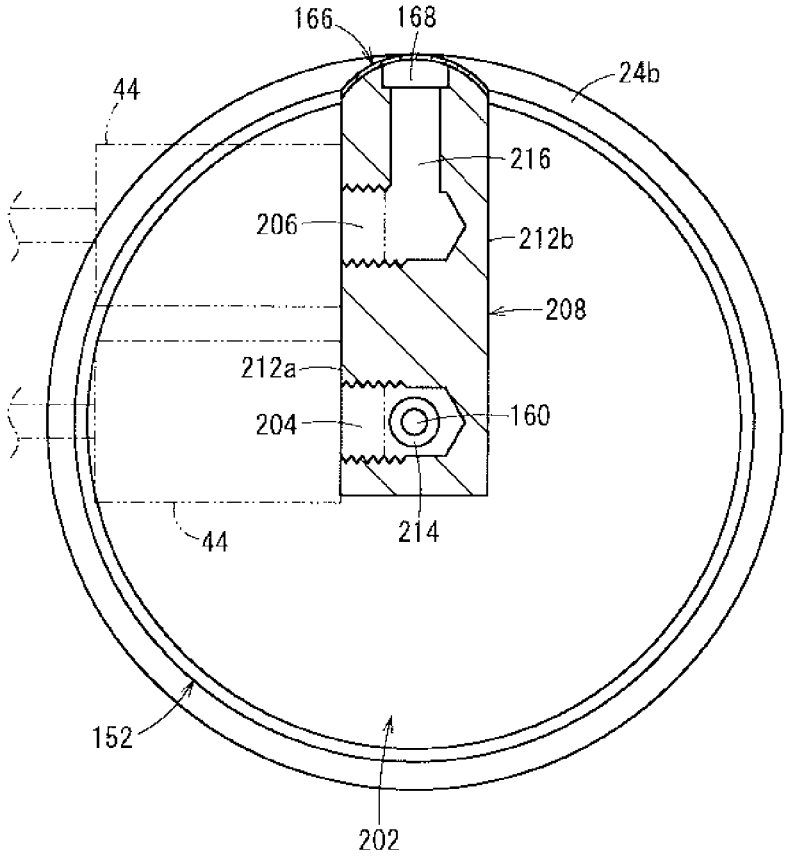
FIG. 13 is a cross-sectional view taken along line XIII-XIII of FIG. 12.

Next, a fluid pressure cylinder 200 according to a fourth embodiment is shown in FIGS. 12 and 13. Constituent elements, which are the same as those of the above-described fluid pressure cylinder 150 according to the third embodiment, are denoted by the same reference characters, and detailed description of such features is omitted.

As shown in FIGS. 12 and 13, the fluid pressure cylinder 200 according to the fourth embodiment differs from the fluid pressure cylinder 150 according to the third embodiment, in that a port member 208 having first and second fluid ports 204, 206 therein is disposed with respect to a head cover 202, and the first and second fluid ports 204, 206 open respectively in lateral directions substantially perpendicular to the axial direction (the directions of arrows A and B) of the fluid pressure cylinder 200.

The port member 208 is, for example, a block body formed with a rectangular shape in cross section, and which extends diametrally such that one end thereof is arranged substantially in the center of the head cover 202, and the other end is arranged on the outer circumferential side of the head cover 202, while in addition, a planar attachment surface 210 of the block body is fixed by welding or the like in a state of abutment against an end surface of the head cover 202.

Further, the port member 208 includes a pair of flat surfaces 212*a*, 212*b* (see FIG. 13) that are substantially perpendicular with respect to the attachment surface 210, with the first and second fluid ports 204, 206 opening on one of the flat surfaces 212*a*. The first fluid port 204 is disposed on one end side of the port member 208, and is connected to a first communication passage 214 that communicates with the first communication hole 160 of the head cover 202. The first communication passage 214 extends in a direction (the direction of the arrow A) perpendicular to the lengthwise direction of the port member 208, and is formed on the same axis as (i.e., coaxially with) the first communication hole 160.

The second fluid port 206 is disposed on the other end side of the port member 208 at a predetermined distance from the first fluid port 204, and communicates with a second communication passage 216 that extends to the other end side.

In addition, the other end portion of the port member 208 is formed with an arcuate shape in cross section, and the passage member 166, which is formed with an arcuate shape in cross section, is mounted thereon so as to cover the other end portion. In this manner, the end of the second communication passage 216 is covered by the passage member 166, and communicates with the flow path 168 that is surrounded by the passage member 166 and the outer circumferential surface of the cylinder tube 152.

Fittings 44 (the two-dot-dashed line shapes) are connected respectively to the first and second fluid ports 204, 206 from a sideways direction perpendicular to the lengthwise direction of the port member 208, and a pressure fluid is supplied to and discharged from the fluid ports through piping. Stated otherwise, the first and second fluid ports 204, 206 open in a direction perpendicular to the axial direction (the directions of arrows A and B) of the cylinder tube 152, and are disposed in parallel along a diametral direction of the head cover 202.

Because the operations of the fluid pressure cylinder 200 according to the fourth embodiment are the same as the operations of the fluid pressure cylinder 150 according to the third embodiment, detailed descriptions of such operations are omitted.

As has been described above, with the fluid pressure cylinder 200 according to the fourth embodiment, the port member 208 having the first and second fluid ports 204, 206 through which the pressure fluid is supplied and discharged is disposed on the head cover 202, which is provided on one end of the cylinder tube 152, and the first and second fluid ports 204, 206 open on a flat surface 212*a* of the port member 208 which is substantially perpendicular to the axial direction (the directions of arrows A and B) of the cylinder tube 152.

Consequently, in the diametral direction of the fluid pressure cylinder 200, fittings 44 connected to the first and second fluid ports 204, 206 are disposed in the vicinity of the center of the head cover 202, whereby the amount at which the fittings 44 project diametrally outward on the fluid pressure cylinder 200 can be suppressed, and compared to the aforementioned fluid pressure cylinder 150, the amount at which the fittings 44 and pipings project in the axial direction can also be suppressed.

As a result, the fluid pressure cylinder 200 can be reduced in size in the axial direction (the directions of arrows A and B), along with enabling the first and second fluid ports 204, 206 to be connected at positions inwardly from the outer circumferential surface of the cylinder tube 152. Thus, for example, in an installation environment for the fluid pressure cylinder 200, even if there is no margin of space available on the outer circumferential side and in the axial direction side of the fluid pressure cylinder 200, it is still possible for the fluid pressure cylinder 200 to be easily arranged and utilized.

Further, the port member 208 is not limited to being a separate body that is fixed with respect to the head cover 202, as in the above-described fluid pressure cylinder 200. For example, the head cover 202 may be formed with a certain thickness in the axial direction (the directions of arrows A and B), and a port section having first and second fluid ports may be formed directly therein along the axial direction.

Next, a case will be described with reference to FIGS. 14 through 20 in which the aforementioned fluid pressure cylinders 10, 100, 150, 200 are attached with respect to other members E1, E2 that are disposed substantially in parallel with the axial direction. A fluid pressure cylinder 220 to be described below, for example, is of a structure which is basically the same as that of the fluid pressure cylinder 10 according to the first embodiment.

Figure 14:
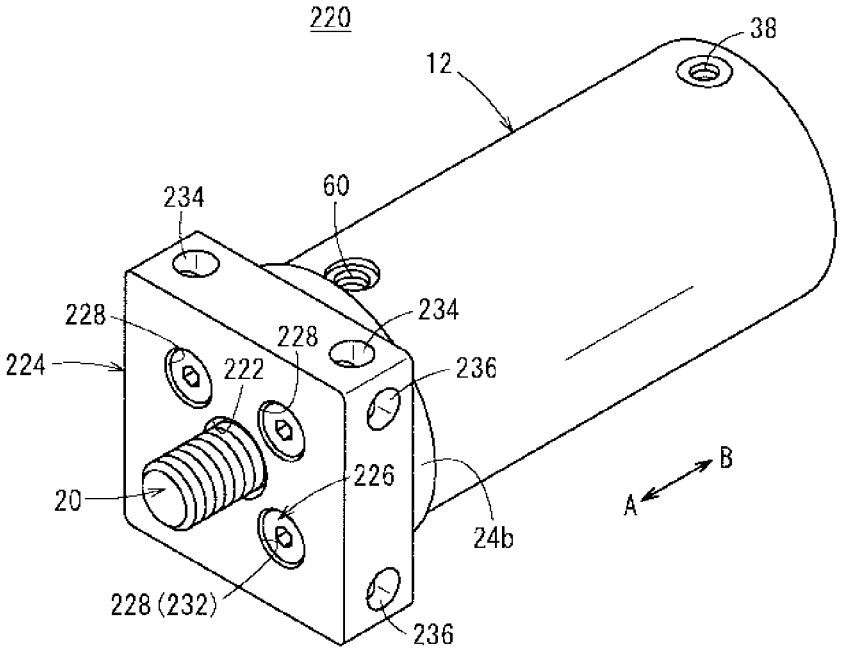
FIG. 14 is an exterior perspective view showing a condition in which an attachment is installed thereon for attaching the fluid pressure cylinder of FIG. 1 to another member.
Figure 15:
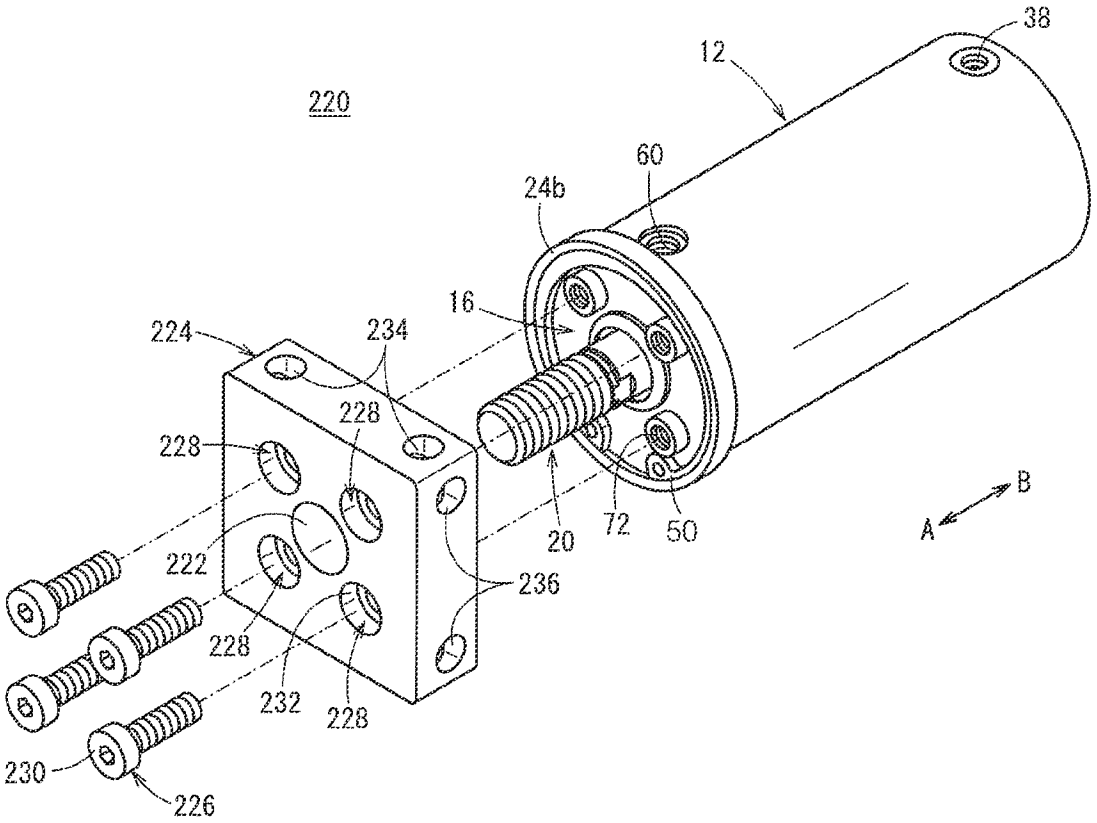
FIG. 15 is a partially exploded perspective view showing a condition in which the attachment is removed from the fluid pressure cylinder of FIG. 14.

As shown in FIGS. 14 and 15, on the fluid pressure cylinder 220, an attachment (attachment member) 224, having a through hole 222 therein through which the piston rod 20 is inserted, is installed on an end of the rod cover 16.

As shown in FIGS. 14 through 20, the attachment 224 is made up from a block body with a rectangular shape in cross section formed from a metal material, and substantially in the center thereof, the through hole 222 penetrates from one end surface abutting against the rod cover 16 to another end surface thereof. The piston rod 20, which projects out from the rod cover 16, is inserted through the through hole 222. Further, in the attachment 224, four insertion holes 228 are formed through which fastening bolts 226 are inserted on corner sides about the through hole 222. The insertion holes 228 include accommodating sections 232 formed in the other end surface side (in the direction of the arrow A) and in which head portions 230 of the fastening bolts 226 are accommodated.

In addition, in a state in which the attachment 224 abuts against the rod cover 16 with the piston rod 20 being inserted through the through hole 222, the insertion holes 228 are arranged substantially coaxially with the second attachment holes 72 of the rod cover 16, and by respective screw-engagement of the fastening bolts 226, which are inserted through the insertion holes 228, with respect to the second attachment holes 72, the attachment 224 is fixed to an end of the fluid pressure cylinder 220 (see FIG. 14).

Figure 18:
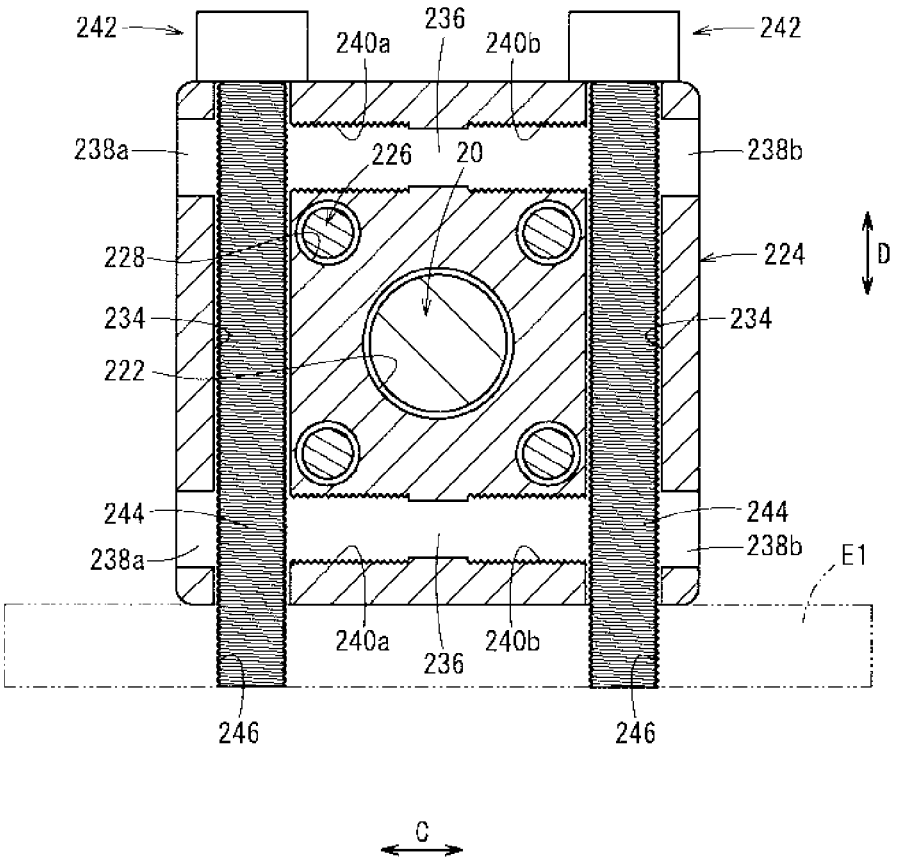
FIG. 18 is a cross-sectional view of a condition in which the fluid pressure cylinder of FIG. 17 is fixed.
Figure 20:
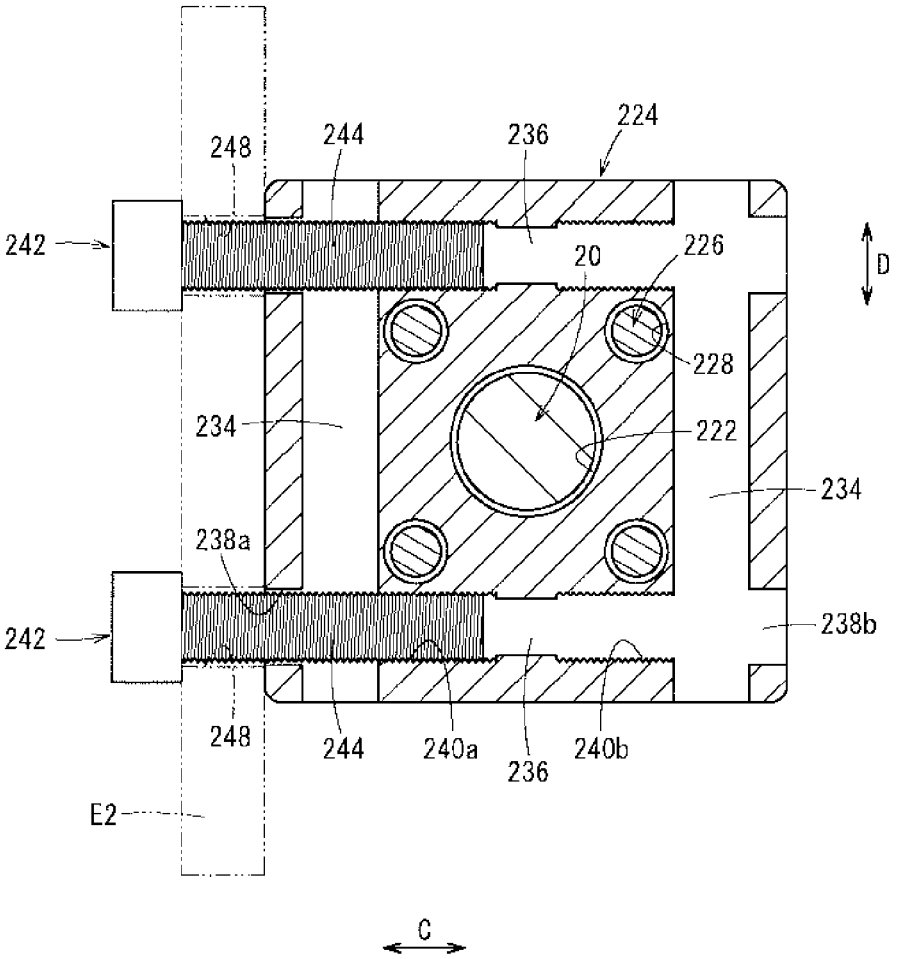
FIG. 20 is a cross-sectional view of a condition in which the fluid pressure cylinder of FIG. 19 is fixed.

On the other hand, in the attachment 224, on side surfaces thereof perpendicular to the one end surface and the other end surface, a pair of first bolt holes 234 is formed. As shown in FIGS. 18 and 20, the first bolt holes 234 are formed while being separated mutually at a predetermined distance along a widthwise direction (the directions of the arrow C), so as to extend in straight line shapes with a substantially constant diameter on a more outward side than the insertion holes 228, and further, penetrate along the height direction (the direction of the arrow D). More specifically, in a state in which the attachment 224 is installed on the fluid pressure cylinder 220, as shown in FIG. 14, the first bolt holes 234 extend in the same direction as the first and second fluid ports 38, 60.

Further, on other side surfaces of the attachment 224, which are perpendicular to the one side surfaces on which the first bolt holes 234 open, a pair of second bolt holes 236, which extend in a horizontal direction, are formed to penetrate therethrough. As shown in FIGS. 18 and 20, the second bolt holes 236 are separated by a predetermined distance mutually in the height direction of the attachment 224 (the directions of the arrow D) on a more outward side than the insertion holes 228, and are formed perpendicularly to the first bolt holes 234, respectively.

More specifically, as shown in FIGS. 18 and 20, when observed from the direction in which the insertion holes 228 extend, in the attachment 224, the through holes 222 and the insertion holes 228 are formed so as to be surrounded by the first and second bolt holes 234, 236.

In the second bolt holes 236, there are formed as pairs in each thereof, insertion portions 238*a*, 238*b* that extend in the widthwise direction (the directions of the arrow C) from ends that open on the other side surfaces to regions intersecting with the first bolt holes 234, and threaded portions 240*a*, 240*b* that extend from the intersecting regions toward a central side in the widthwise direction.

Figure 17:
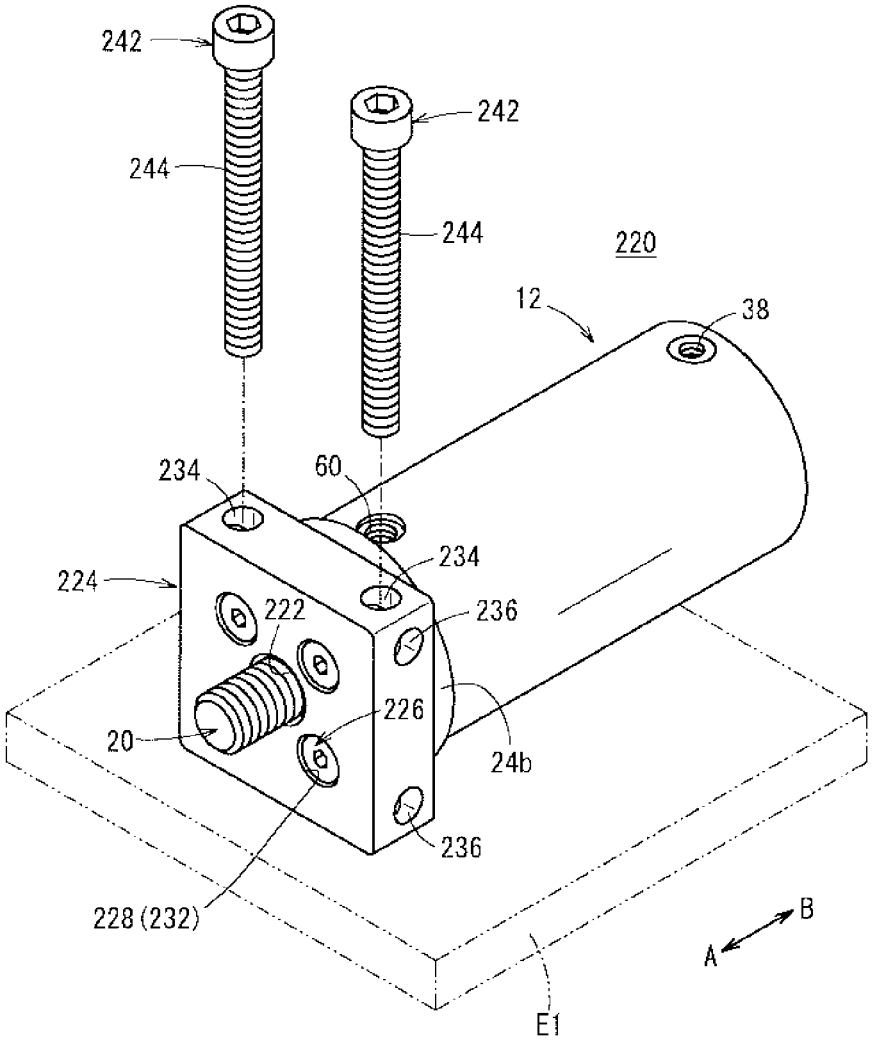
FIG. 17 is an exterior perspective view showing a condition prior to assembly, of a case in which the fluid pressure cylinder of FIG. 14 is fixed to another member arranged below the fluid pressure cylinder.

As shown in FIGS. 17 and 18, in the case that the fluid pressure cylinder 220, to which the attachment 224 is installed with respect to the rod cover 16, is fixed to another member E1 provided on a lower surface side thereof, in a condition with the lower surface of the attachment 224 abutting against the other member E1, from above, fixing bolts 242 are inserted in and through the first bolt holes 234, and as shown in FIG. 18, fastening portions 244 thereof are screw-engaged into screw holes 246 of the other member E1. Consequently, by the fixing bolts 242, the attachment 224 is fixed to the upper surface of the other member E1, accompanied by the fluid pressure cylinder 220 on which the attachment 224 is installed being fixed to the upper surface side of the other member E1.

Figure 19:
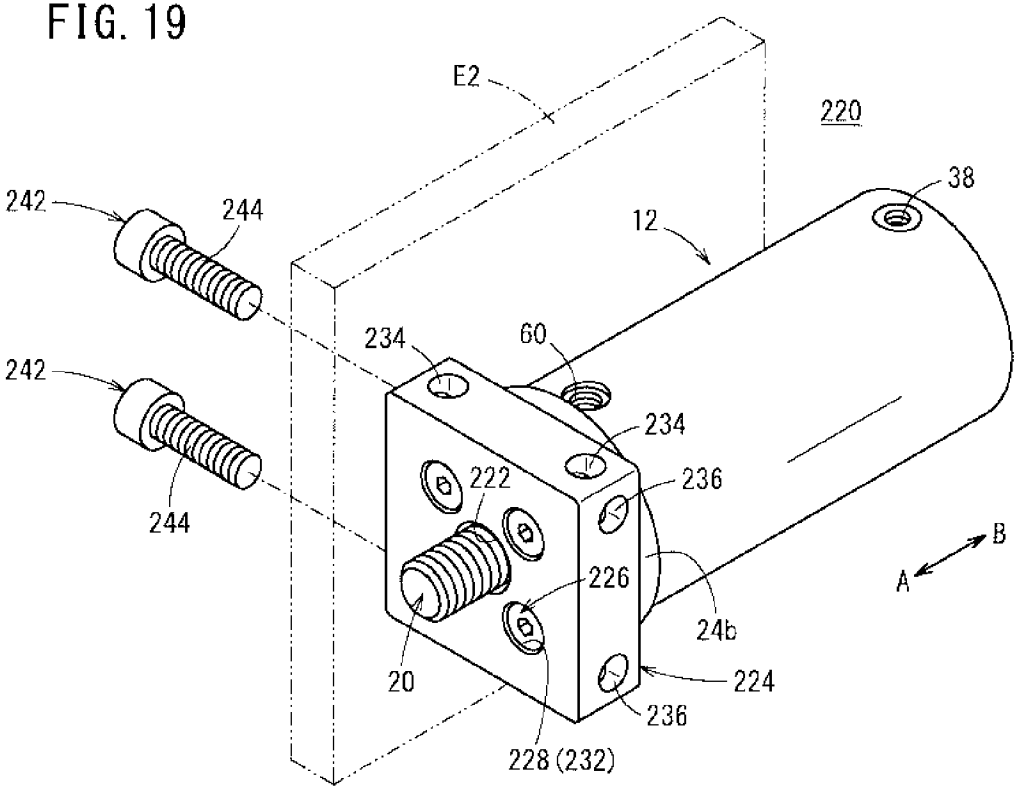
FIG. 19 is an exterior perspective view showing a condition prior to assembly, of a case in which the fluid pressure cylinder of FIG. 14 is fixed to another member arranged on a side of the fluid pressure cylinder.

On the other hand, as shown in FIGS. 19 and 20, corresponding to the environment and application of use of the fluid pressure cylinder 220, in the case that the fluid pressure cylinder 220 is fixed laterally with respect to another member E2, in a state in which another side surface of the attachment 224 in which the second bolt holes 236 are opened is placed in abutment against the other member E2, as shown in FIG. 20, the fastening portions 244 of the fixing bolts 242, which have been inserted through holes 248 of the other member E2, are passed through the insertion portions 238*a* of the second bolt holes 236 and are screw-engaged with the threaded portions 240*a*. Consequently, via the fixing bolts 242, the fluid pressure cylinder 220 can be mounted laterally with respect to the other member E2. Stated otherwise, the fluid pressure cylinder 220 is fixed to the other member E2 on the other side surface side thereof.

In the foregoing manner, the attachment 224 is installed with respect to the rod cover 16 of the fluid pressure cylinder 220 using the second attachment holes 72. In addition, the first and second bolt holes 234, 236, which penetrate in different directions perpendicular to the axial direction (the directions of arrows A and B) of the rod cover 16, are provided in the attachment 224, the fixing bolts 242 are inserted selectively with respect to the first and second bolt holes 234, 236, and are screw-engaged with the other members E1, E2 that the attachment 224 abuts against. Therefore, the fluid pressure cylinder 220, which is capable of being reduced in size in diametral and axial directions, can be fixed in various different directions corresponding, for example, to the environment of use thereof.

Further, since the attachment 224 is disposed detachably through the fastening bolts 226, the attachment 224 can be exchanged or replaced with another attachment having differently shaped bolt holes therein.

Furthermore, since the attachment 224 is installed using the second attachment holes 72 provided in the rod cover 16, a favorable result is achieved in that there is no need for additional process steps or other members to be provided in order to mount the attachment 224 with respect to the fluid pressure cylinder 220.

Figure 16:
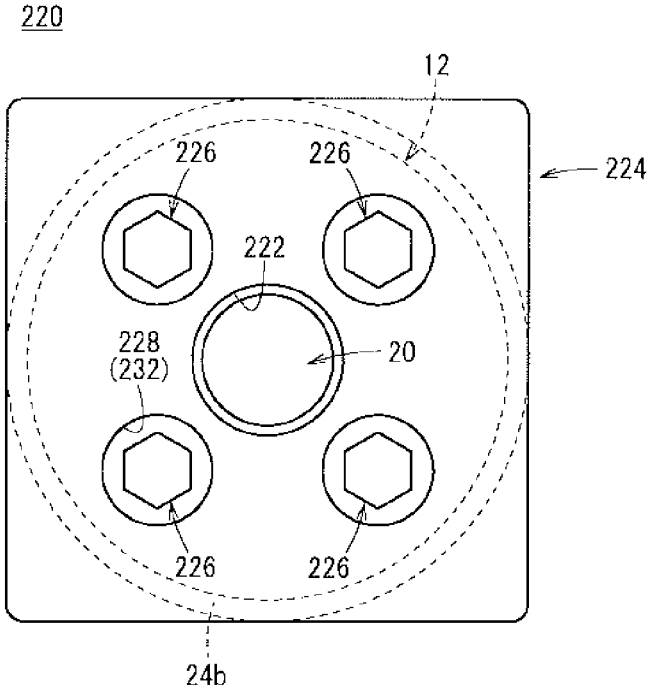
FIG. 16 is a front view in which the fluid pressure cylinder of FIG. 14 is seen from the attachment side.

Further still, as shown in FIG. 16, since the attachment 224 has a widthwise dimension which is the same as the outer diameter of the cylindrical body 24*b* provided on the end of the cylinder tube 12 having a circular shape in cross section, when the attachment 224 is fixed to the other members E1, E2, the cylinder tube 12 does not come into contact with the other members E1, E2.

Still further, the attachment 224 is not limited to the case of being installed with respect to the rod cover 16 as described above. For example, using the first attachment holes 52, the attachment 224 may be installed on an end of the head cover 14.

Further, without being formed with a rectangular shape in cross section as described above, but by being formed, for example, with a polygonal shape in cross section and providing additional bolt holes therein, the attachment 224 is capable of being attached in a greater number of directions.

The fluid pressure cylinder according to the present invention is not limited to the embodiments described above. Various changes and modifications may be made to the embodiments without departing from the scope of the invention as set forth in the appended claims.

The invention claimed is:

1. A fluid pressure cylinder comprising a cylindrical cylinder tube including a cylinder chamber in interior thereof that is circular in cross section, cover members formed with circular shapes in cross section and which are mounted at respective ends of the cylinder tube, and a piston disposed displaceably along the cylinder chamber, wherein:

the cover members include a rod cover mounted at one end of the cylinder tube and a head cover having a plate shape and being mounted at another end of the cylinder tube, a cylindrical body is connected to one end of the cylinder tube and is greater in diameter than the cylinder tube;

a pair of ports through which a pressure fluid is supplied and discharged are disposed in port members, one of the port members disposed at the another end side of the cylinder tube being fixed with respect to an inner circumferential surface of the cylinder tube by welding and extending inward from the cylinder tube, the one of the port members disposed at the another end side of the cylinder tube being entirely arranged at an interval in an axial direction of the cylinder tube with respect to the plate shaped head cover; and a latching member is disposed in the cylindrical body, the latching member being engaged with respect to the cylindrical body to latch one of the cover members in an axial direction and being constituted from a ring which is resilient in a diametric direction, and the cover member is attachable and detachable with respect to the cylinder tube by attachment and detachment of the ring with respect to the cylindrical body.

2. The fluid pressure cylinder according to claim 1, wherein the one of the cover members comprises a circumferential wall portion extending in the axial direction and in sliding contact with an inner circumferential surface of the cylindrical body, and wherein said one of said port members is fixed to the circumferential wall portion and extends diametrically inwardly from the circumferential wall portion.

3. The fluid pressure cylinder according to claim 2, further comprising a fitting extending through a port hole of said cylindrical body and connected to said one of said port members, whereby relative rotation between said one of the cover members and said cylindrical body is prevented.

4. A fluid pressure cylinder comprising:

a cylindrical cylinder tube including a cylinder chamber in interior thereof that is circular in cross section;

cover members formed with circular shapes in cross section and which are mounted at respective ends of the cylinder tube;

a piston disposed displaceably along the cylinder chamber;

a pair of ports disposed in port members fixed with respect to an end surface of one of the cover members, and through which a pressure fluid is supplied and discharged;

a cylindrical body which is larger in diameter than the cylinder tube, the cylindrical body abutting an outer circumferential surface of the cylinder tube at an end of the cylinder tube opposite the one of the cover members;

a latching member disposed in the end of the cylinder tube opposite the one of the cover members, the latching member being engaged with respect to the cylindrical body and the cylinder tube to latch another of the cover members in an axial direction, the latching member being constituted from a ring which is resilient in a diametric direction, and the another cover member is attachable and detachable with respect to the cylinder tube by attachment and detachment of the ring with respect to the cylinder tube; and a passage member provided on at an outer side of the cylinder tube and defining a passage on an outer side of the cylinder tube, the passage member communicating with one of the port members and with the cylinder chamber that is disposed at the end of the cylinder tube opposite the one of the cover members having the pair of ports, wherein the passage member extends in the axial direction from the one of the cover members to terminate at a location that is closer to the one of the cover members than is the cylindrical body, whereby the cylindrical body is able to abut an entirety of the outer circumferential surface of the cylinder tube, and wherein the passage member does not project diametrically outward beyond an outer circumferential surface of the cylindrical body.

5. The fluid pressure cylinder according to claim 4, wherein the passage member has an arcuate shape in cross section, and provides a flow path in interior thereof due to being placed in contact with the outer circumferential surface of the cylinder tube.

6. The fluid pressure cylinder according to claim 4, further comprising an attachment member provided on the one of the cover members, the attachment member including bolt holes that extend in directions perpendicular to a displacement direction of the piston and through which fixing bolts are inserted.

7. The fluid pressure cylinder according to claim 6, wherein the bolt holes extend in at least two different directions.

8. The fluid pressure cylinder according to claim 6, wherein the attachment member is fixed with respect to an attachment hole formed in the end of the one of the cover members.

9. A fluid pressure cylinder comprising:

a cylindrical cylinder tube including a cylinder chamber in interior thereof that is circular in cross section;

cover members formed with circular shapes in cross section and which are mounted at respective ends of the cylinder tube;

a piston disposed displaceably along the cylinder chamber;

a pair of ports disposed in port members fixed with respect to an end surface of one of the cover members, and through which a pressure fluid is supplied and discharged;

a cylindrical body which is larger in diameter than the cylinder tube, the cylindrical body abutting an outer circumferential surface of the cylinder tube at an end of the cylinder tube opposite the one of the cover members;

a latching member disposed in the end of the cylinder tube opposite the one of the cover members, the latching member being engaged with respect to the cylindrical body and the cylinder tube to latch another of the cover members in an axial direction, the latching member being constituted from a ring which is resilient in a diametric direction, and the another cover member is attachable and detachable with respect to the cylinder tube by attachment and detachment of the ring with respect to the cylinder tube; and a passage member provided directly in contact with an outer side of the cylinder tube and defining a passage on an outer side of the cylinder tube, the passage member communicating with one of the port members and with the cylinder chamber that is disposed at the end of the cylinder tube opposite the one of the cover members having the pair of ports, wherein the passage member extends in the axial direction from the one of the cover members to terminate at a location that is closer to the one of the cover members than is the cylindrical body, whereby the cylindrical body is able to abut an entirety of the outer circumferential surface of the cylinder tube.

* * * * *